US006037918A

United States Patent [19]

Hansen et al.

[11] Patent Number: 6,037,918

[45] Date of Patent: Mar. 14, 2000

[54] ERROR COMPENSATOR CIRCUITS USED IN COLOR BALANCING WITH TIME MULTIPLEXED VOLTAGE SIGNALS FOR A FLAT PANEL DISPLAY UNIT

[75] Inventors: Ronald L. Hansen, San Jose; Jay Friedman, Felton; Paul Freiberg, Palo Alto, all of Calif.

[73] Assignee: Candescent Technologies, Inc., San Jose, Calif.

[21] Appl. No.: 09/050,664

[22] Filed: Mar. 30, 1998

[51] Int. Cl.[7] ..... G09G 3/22

[52] U.S. Cl. ..... 345/74; 345/75

[58] Field of Search ..... 345/74, 75, 204, 345/205, 206, 211, 212, 213, 153, 155, 98, 100; 315/169.1, 169.3, 169.2

[56] References Cited

U.S. PATENT DOCUMENTS

| | | | |
|---|---|---|---|
| 5,708,451 | 1/1998 | Baldi | 345/75 |
| 5,734,361 | 3/1998 | Suzuki et al. | 345/74 |
| 5,834,900 | 11/1998 | Tanaka et al. | 345/74 |
| 5,910,792 | 6/1999 | Hansen et al. | 345/74 |

*Primary Examiner*—Xiao Wu
*Attorney, Agent, or Firm*—Wagner, Murabito & Hao LLP

[57] ABSTRACT

A circuit and method for time multiplexing a voltage signal for controlling the color balance of a flat panel display. Within an FED screen, a matrix of rows and columns is provided and emitters are situated within each row-column intersection. Row drivers are sequentially activated during "row on-time windows" and corresponding individual gray scale information (voltages) are driven by the column drivers. When the proper voltage is applied across the cathode and anode of the emitters, electrons are released toward a phosphor spot, e.g., red, green, blue, causing illumination. Within each column driver, selection circuitry is provided for driving a first voltage data during a first part of the row on-time window and a second voltage data during a second part of the row on-time window. The lengths of the first part and second part of each row on-time window can be adjusted, for a given color, to adjust the color balance with respect to that color. In one embodiment, two data translators or "error compensation circuits" are used to compensate for errors caused by dividing the first voltage data when obtaining the second voltage data. Considering consecutive frame pairs, a first error compensation circuit is operable during the first frame of each frame pair and generates a second voltage data having negative error. A second error compensation circuit is operable during the second frame of each frame pair and generates a second voltage data having positive error. Statistically, the negative and positive errors cancel although different color data is presented at a same pixel from one frame to another.

20 Claims, 28 Drawing Sheets

ERROR COMPENSATOR CIRCUITS USED IN COLOR BALANCING WITH TIME MULTIPLEXED VOLTAGE SIGNALS FOR A FLAT PANEL DISPLAY UNIT

BACKGROUND OF THE INVENTION

1. Field of the Invention

The present invention relates to the field of flat panel display screens. More specifically, the present invention relates to the field of flat panel field emission display (FED) screens.

2. Related Art

In the field of flat panel display devices, much like conventional cathode ray tube (CRT) displays, a white pixel is composed of a red, a green and a blue color point or "spot." When each color point of the pixel is excited simultaneously, the pixel appears white. To produce different colors at the pixel, the intensity to which the red, green and blue points are driven is altered using well known techniques. The separate red, green and blue data that correspond to the color intensities of a particular pixel are called the pixel's color data. Color data is often called gray scale data. The degree to which different colors can be achieved within a pixel is referred to as gray scale resolution and is directly related to the amount of different intensities to which each red, green and blue point can be driven.

Field emission display (FED) screens, like CRT displays, utilize phosphor spots to generate the red, green and blue color points of a pixel. Often, during manufacturing, the characteristics of the phosphor of the display screen for a particular color can vary from screen to screen. If the phosphor has different characteristics, then its color intensity will vary from screen to screen thereby producing screens with different color balance. Therefore, it is important that a display screen have a mechanism for altering the relative color intensities of the color points so that manufacturing variations in the phosphor can be compensated for in the display screen. The method of altering the relative color intensities of the color points across a display screen is called white balance adjustment (also referred to as color balance adjustment or color temperature adjustment).

Another reason for providing color balance adjustment, in addition to correcting for manufacturing variations in the phosphor, is to correct for phosphor aging through prolonged display use. It is typical for the light emitting characteristics of the phosphor of an FED screen to change over time as it is used. Therefore, it is important that a display screen have a mechanism for altering its color balance to correct for phosphor aging to maintain image quality throughout the life of the FED screen. A further reason for providing color balance adjustment within a display screen is to allow the viewer to manually adjust the color balance. Using a manual adjustment, users can adjust the white balance of the display screen to their particular viewing taste.

One method for correcting or altering the color balance within a display screen is to alter, on the fly, the color data used to render a screen. Instead of sending a particular color point a color value of X, the color value of X is first passed through a function that has complex gain and offset adjustments. The output of the function, Y, is then sent to the color point. The function compensates for any variations in the color temperature caused by phosphor variations. The gain and offset factors of the above function can be altered as the color temperature needs to be increased or decreased. Although offering dynamic color balance adjustment, this prior art mechanism for altering the color balance is disadvantageous because it requires relatively complex circuitry for altering a relatively large volume of color data. For instance, in order to represent the color balance function, a look-up table (LUT) is used for each column.

The additional circuitry (e.g., a LUT) that this prior art mechanism requires adds significantly to the overall size of the driver circuits and negatively impacts performance speed. Assuming a horizontal screen resolution of 1024 white pixels, there can be as many as 3072 column drivers per FED screen and a complex LUT circuit replicated over 3072 column drivers may require too much substrate area for practical fabrication. Secondly, this prior art mechanism may degrade the quality of the image by reducing the gray-scale resolution of the flat panel display. It is desirable to provide a color balance adjustment mechanism for a flat panel display screen that does not alter the image data nor compromise the gray-scale resolution of the image.

Another method of correcting for color balance within a flat panel display screen is used in active matrix flat panel display screens (AMLCD). This method pertains to altering the physical color filters used to generate the red, green and blue color points. By altering the color the filters, the color temperature of the AMLCD screen can be adjusted. However, this adjustment is not dynamic because the color filters need to be physically (e.g., manually) replaced each time adjustment is required. It would be advantageous to provide a color balancing mechanism for a flat panel display screen that can respond, dynamically, to required changes in the color temperature of the display.

FIG. 1 illustrates a graph 6 of a typical data-in voltage-out curve that is embedded within a digital to analog converter circuit of an AMLCD flat panel display. The digital to analog converter is responsible for transforming the digital color data to voltages that are used to generate the actual color intensity. When presented with color data from 0 to 63, the voltages corresponding to curve portion 2 are supplied as output to drive the color points. When presented with color data from 64 to 127, the voltages corresponding to curve portion 4 are supplied as output to drive the color points. Curve portion 4 may be the same as curve portion 2 except with a DC voltage offset. Curve portion 4 and curve portion 2 are used in alternating refresh cycles so that no net DC voltage is applied to the cells of the AMLCD display. Prolonged exposure to DC voltage can destroy the AMLCD display. Therefore, the gray scale resolution of the AMLCD device using curves 2 and 4 is only from 0 to 63, although 127 data positions exist. This is the case because positions 64 to 127 are only duplicates, respectively, of positions 0 to 63. Although used in the manner described above, the data-in voltage-out function of FIG. 1 has never been applied to perform any type of color balancing operations.

Accordingly, the present invention provides a mechanism and method for dynamically adjusting the color balance of a flat panel display. The present invention provides a mechanism and method for adjusting the color balance of a flat panel display screen that does not significantly compromise the gray-scale resolution of the pixels of the display screen. Further, the present invention provides a mechanism and method for adjusting the color balance of a flat panel display screen without significantly increasing the size of the column driver circuits. Further, the present invention provides a mechanism and method for controlling the color balance of a flat panel FED screen while providing a power savings operational mode. These and other advantages of the present invention not specifically mentioned above will become clear within discussions of the present invention presented herein.

SUMMARY OF THE INVENTION

A circuit and method are described for time multiplexing a voltage signal for controlling the color balance of a flat panel display. Adjustment of color balancing can be done in response to tube aging, viewer taste and/or manufacturing variations in the phosphor. Within an FED screen, a matrix of rows and columns is provided and emitters are situated within each row-column intersection. Rows are sequentially activated during "row on-time windows" by row drivers and corresponding individual gray scale information (voltages) are driven over the columns by column drivers. When the proper voltage is applied across the cathode and anode of the emitters, electrons are released toward a phosphor spot, e.g., red, green, blue, causing illumination. Within each column driver, the present invention provides selection circuitry for driving a first voltage signal during a first ("full") part of the row on-time window and a second voltage signal during a second ("half") part of the row on-time window. The total or effective voltage applied to a given column is therefore a weighted average of the two voltages applied during the first part and the second part of the row on-time window. The weights of the weighted average is represented by the respective lengths of the first and second parts, respectively.

The lengths of the first part and second part of the row on-time window can be adjusted, individually for a given color, to adjust the total voltage applied. This effectively adjusts the color balance with respect to that color, e.g., red, green or blue. In a first embodiment of the present invention, a shift register is used to divide a digital representation of the first voltage value in half for application during the second part of the row on-time window. The first voltage value being applied during the first part of the row on-time window. In a second embodiment, a multiplexer is used to divide the first voltage value in half for application during the second part. Again, the first voltage value being applied during the first part of the row on-time window. In a third embodiment, the order of the first and second parts of the row on-time window are swapped with respect to every other consecutive row on-time window such that two first parts occur consecutively and two second parts occur consecutively over a period of two row on-time windows. The third embodiment reduces the frequency of voltage changes on the column lines and thereby saves power.

In a fourth embodiment of the present invention, two data translators or "error compensation circuits" are used within each column driver circuit to compensate for errors caused by dividing the first voltage data when obtaining the second voltage data. Considering consecutive pairs of display frames, a first error compensation circuit is operable during the frame of each frame pair and generates a second voltage data that has negative error (e.g., it is lower than exactly half its first voltage data). A second error compensation circuit is operable during the second frame of each frame pair and generates a second voltage data that has positive error (e.g., it is higher than exactly half its first voltage data). Statistically, the negative and positive errors cancel even though different color data is presented for a same pixel within the first frame and the next frame of each frame pair. Further, the negative and positive error contributions cancel in mirror fashion, regardless of the relative lengths of the first ("full") part and second ("half") part of each row on-time window. This is the case because these relative lengths are the same for the first and second frames of each frame pair thereby causing the same absolute value of negative and positive error.

DETAILED DESCRIPTION OF THE INVENTION

In the following detailed description of the present invention, a method and mechanism for using time multiplexing of voltage signals for dynamically altering the color balance within a flat panel FED screen without significantly compromising gray-scale resolution, numerous specific details are set forth in order to provide a thorough understanding of the present invention. However, it will be recognized by one skilled in the art that the present invention may be practiced without these specific details or with equivalents thereof. In other instances, well known methods, procedures, components, and circuits have not been described in detail so as not to unnecessarily obscure aspects of the present invention.

FLAT PANEL FED SCREEN ORGANIZATION OF THE PRESENT INVENTION

Embodiments of the present invention are drawn to mechanisms and methods for providing color balance adjustments within an FED display screen. Preceding a discussion of the color balance adjustment circuitry of the present invention, a discussion of certain elements of an FED display screen is discussed.

Figure 1:
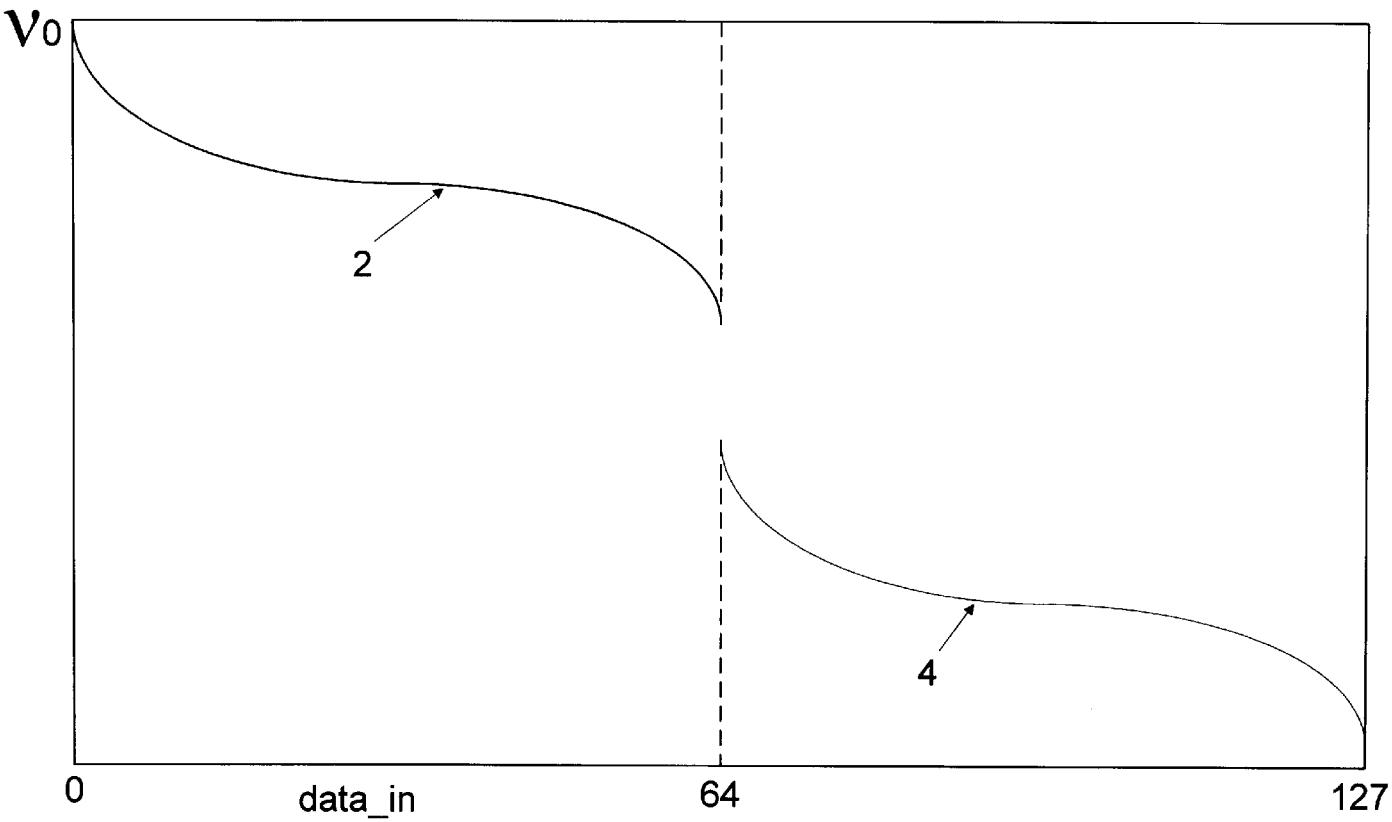
FIGURE 1 (Prior Art)
FIG. 1 illustrates a data-in voltage-out function used by an active matrix liquid crystal display (AMLCD) of the prior art.
Figure 2:
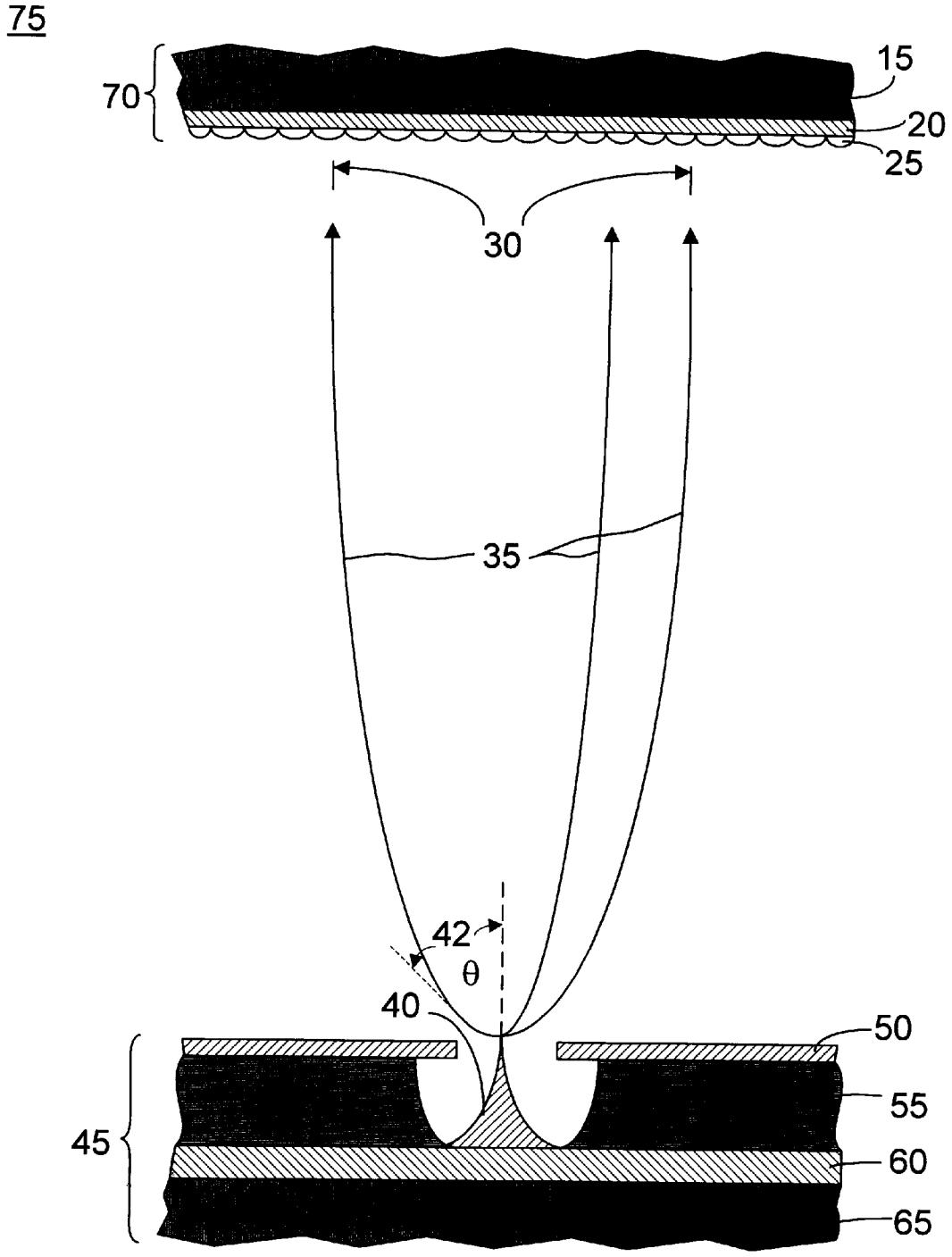
FIG. 2 is a cross-section structural view of part of a flat panel FED screen that utilizes a gated field emitter situated at the intersection of a row line and a column line.

Specifically, a discussion of an emitter of a field emission display (FED) is now presented. FIG. 2 illustrates a cross-sectional diagram of a multi-layer structure 75 which is a portion of an FED flat panel display. The multi-layer structure 75 contains a field-emission backplate structure 45, also called a baseplate structure, and an electron-receiving faceplate structure 70. An image is generated by faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display 75. Faceplate structure 70 is formed with an electrically insulating faceplate 15, an anode 20, and a coating of phosphors 25. Electrons emitted from element 40 are received by phosphors portion 30.

Anode 20 of FIG. 2 is maintained at a positive voltage relative to cathode 60/40. In one embodiment, the anode voltage is 100–300 volts for spacing of 100–200 um between structures 45 and 70 but in other embodiments with greater spacing the anode voltage is in the kilovolt range. Because anode 20 is in contact with phosphors 25, the anode voltage is also impressed on phosphors 25. When a suitable gate voltage is applied to gate electrode 50, electrons are emitted from electron-emissive element 40 at various values of off-normal emission angle theta 42. The emitted electrons follow non-linear (e.g., parabolic) trajectories indicated by lines 35 in FIG. 2 and impact on a target portion 30 of the phosphors 25. The phosphors struck by the emitted electrons produce light of a selected color and represent a phosphor spot or point. A single phosphor spot can be illuminated by thousands of emitters.

Phosphors 25 of FIG. 2 are part of a picture element ("pixel") that contains other phosphors (not shown) which emit light of different color than that produced by phosphors 25. Typically a pixel contains three phosphor or "color" spots, a red spot, a green spot and a blue spot. Also, the pixel containing hosphors 25 adjoins one or more other pixels (not shown) in the FED flat panel display. If some of the electrons intended for phosphors 25 consistently strike other phosphors (in the same or another pixels), the image resolution and color purity can become degraded. As discussed in more detail below, the pixels of an FED flat panel screen are arranged in a matrix form including n columns and x rows. In one implementation, a pixel is composed of three phosphor spots aligned in the same row, but having three separate columns. Therefore, a single pixel is uniquely identified by one row and three separate columns (a red column, a green column and a blue column). As described more fully below, each column of the three columns that constitute a pixel is associated with its own column driver circuit.

The size of target phosphor portion 30 depends on the applied voltages and geometric and dimensional characteristics of the FED flat panel display 75. Increasing the anode/phosphor voltage to 1,500 to 10,000 volts in the FED flat panel display 75 of FIG. 2 requires that the spacing between the backplate structure 45 and the faceplate structure 70 be much greater than 100–200 um. Increasing the interstructure spacing to the value needed for a phosphor potential of 1,500 to 10,000 causes a larger phosphor portion 30, unless electron focusing elements are added to the FED flat panel display of FIG. 2. Such focusing elements can be included within FED flat panel display structure 75 and are described in U.S. Pat. No. 5,528,103 issued on Jun. 18, 1996 to Spindt, et al., which is incorporated herein by reference.

Importantly, the intensity of the target phosphor portion 30 of FIG. 2 depends on the magnitude of the incident current which is itself dependent upon the voltage potential applied across the cathode 60/40 and the gate 50. Thus, the intensity of a color spot is related to the voltage differential applied between the row and column at whose intersection the color spot is located. The larger the voltage potential, the larger the intensity of the target phosphor portion 30. Secondly, the intensity of the target phosphor portion 30 depends on the amount of time a voltage is applied across the cathode 40/60 and the gate 50 (e.g., on-time window). The larger the on-time window, the larger the intensity of the target phosphor portion 30. Therefore, within the present invention, the intensity of FED flat panel structure 75 is dependent on the voltage and the amount of time (e.g., "on-time") the voltage is applied across cathode 60/40 and the gate 50. The effective voltage (EV) is obtained by taking both voltage amplitude and voltage on-time into consideration.

Figure 3:
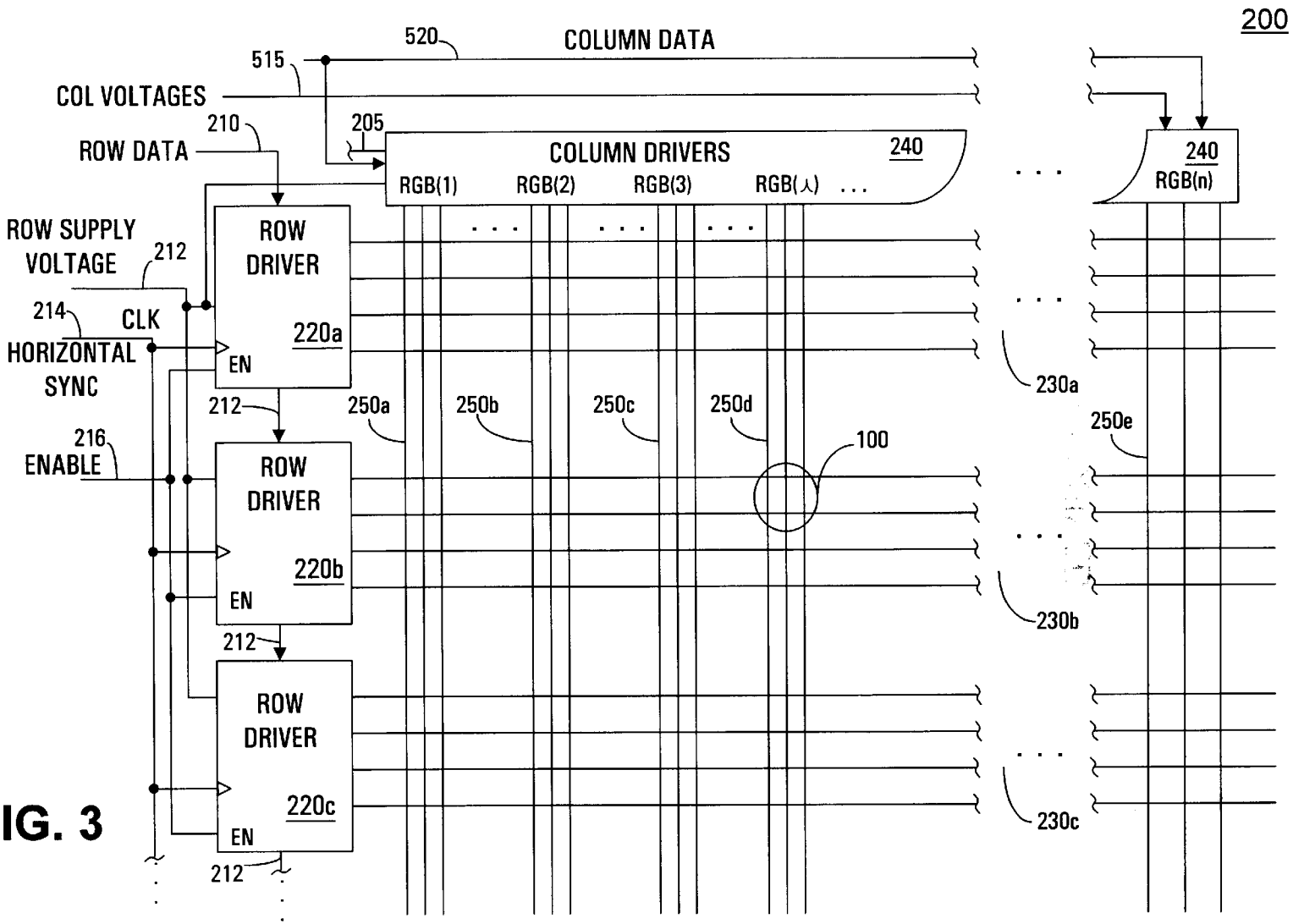
FIG. 3 illustrates a plan view of an flat panel FED screen in accordance with the present invention illustrating row and column drivers and numerous intersecting rows and columns.

As shown in FIG. 3, the FED flat panel display 200 is subdivided into an array of x horizontally aligned row lines 230 ("rows") and n vertically aligned column lines 250 ("columns"). The pixels of the FED flat panel display 200 are also aligned vertically and horizontally. Color points (also called "phosphor spots") are formed at each intersection of row and a column. Three adjacent color points of a same row, a red, a green and a blue, form a pixel. For n pixels horizontally, there are 3n columns. For x pixels vertically, there are x rows. The FED flat panel display 200 of FIG. 3 is described in more detail further below.

Figure 4:
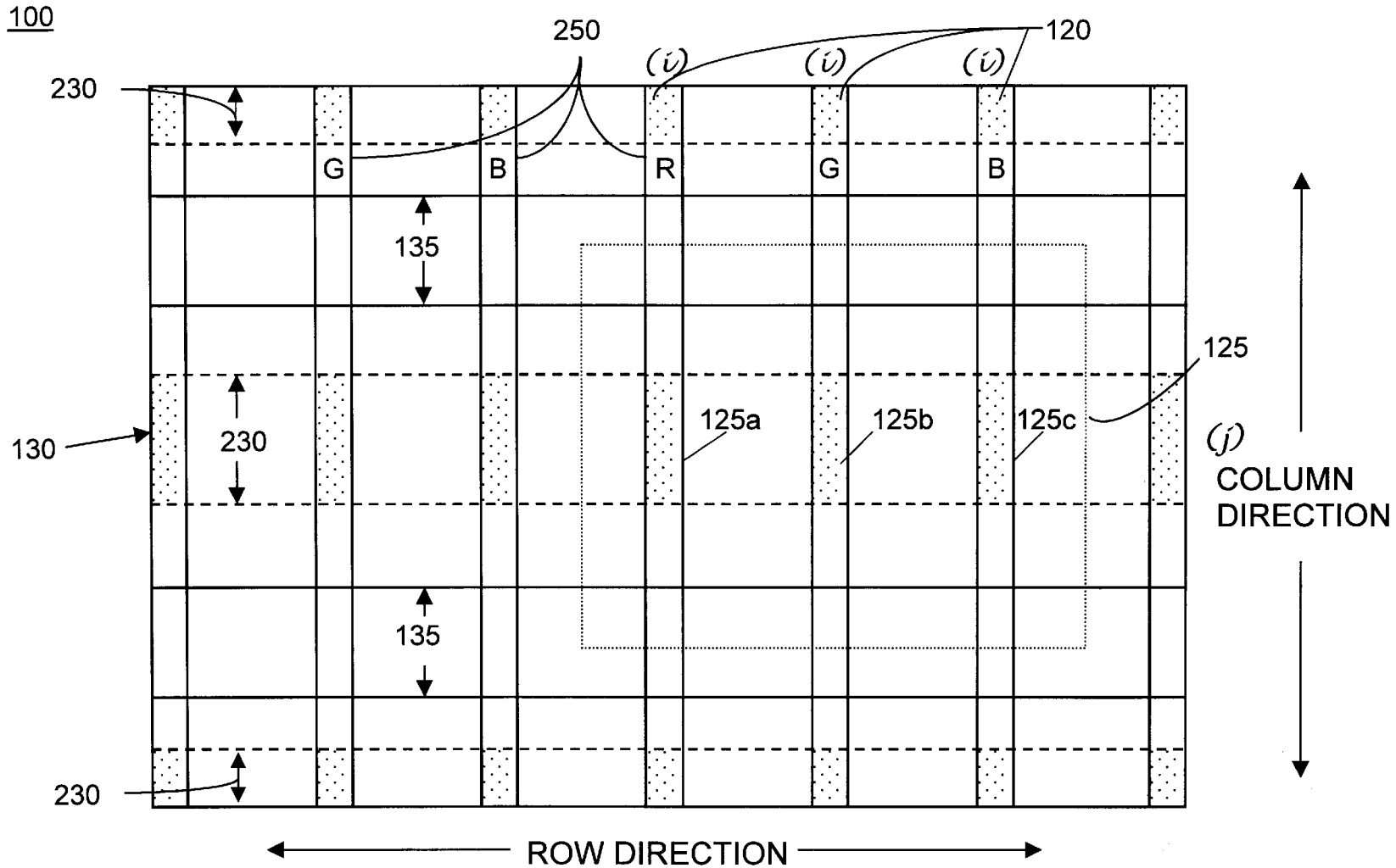
FIG. 4 is a plan view of internal portions of the flat panel FED screen of the present invention and illustrates several intersecting row lines and column lines of the display, including at least one pixel.

A portion 100 of this FED flat panel display 200 is shown in more detail in FIG. 4 and includes at least one full pixel. Specifically, FIG. 4 illustrates a respective pixel 125 (also called "white group"). The respective pixel 125 of FIG. 4 contains a red phosphor spot 125*a*, a green phosphor spot 125*b* and a blue phosphor spot 125*c* of a same emitter line (also called "row electrode" or "row") 230. In one embodiment, each phosphor spot of a pixel is controlled by a different column driver, but all phosphor spots of a pixel are controlled by the same row driver because all phosphor spots of a same pixel reside within the same row 230. The exemplary ith pixel 125 is therefore located at the ith red column line, ith green column line, the ith blue column line and the jth row line.

The boundaries of the respective pixel 125 of FIG. 4 are indicated by dashed lines. Three separate emitter lines 230 (row lines) are also shown. Each emitter line 230 is a row electrode for one of the rows of pixels in the array. The middle row electrode 230 is coupled to the emitter cathodes 60/40 (FIG. 2) of each emitter of the particular row associated with the electrode. A portion of one pixel row is indicated in FIG. 4 and is situated between a pair of adjacent spacer walls 135. A pixel row is comprised of all of the pixels along one row line 250. Two or more pixel rows (and as much as 24–100 pixel rows), are generally located between each pair of adjacent spacer walls 135. Each column of pixels has three gate lines (also called "columns") 250: (1) one for red; (2) a second for green; and (3) a third for blue. Likewise, each pixel column includes one of each phosphor stripes (red, green, blue), three stripes total. Each of the gate lines 250 is coupled to the gate 50 (FIG. 2) of each emitter structure of the associated column. This structure 100 is described in more detail in U.S. Pat. No. 5,477,105 issued on Dec. 19, 1995 to Curtin, et al., which is incorporated herein by reference.

In one embodiment, the red, green and blue phosphor stripes 25 (FIG. 2) are maintained at a positive voltage of 1,500 to 10,000 volts relative to the voltage of the emitter-electrode 60/40. When one of the sets of electron-emission elements 40 is suitably excited by adjusting the voltage of the corresponding row (cathode) lines 230 and column (gate) lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the row on-time period. This is performed sequentially in time, row by row, until all pixel rows have been illuminated to display the frame. Frames are presented at 60 Hz. Assuming n rows of the display array, each row is energized during the row on-time window at a rate of 16.7/n ms. The above FED 100 is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

Row and Column Array. As discussed above, FIG. 3 illustrates an FED flat panel display screen 200 organized as an array of rows and columns in accordance with the present invention. Specifically, the screen contains x rows and n columns of "pixels". Region 100, as described with respect to FIG. 4, is also shown in its relative position in FIG. 3. The FED flat panel display screen 200 consists of x number of row lines (horizontal) and 3n number of column lines (vertical) to achieve (xn) total pixels, e.g., three column lines per pixel are required. For clarity, a row line is called a "row" and a column line is called a "column." Row lines are driven by x row driver circuits 220*a*–220*c* which in one embodiment are integrated circuits. Shown in FIG. 3 are exemplary row groups 230*a*, 230*b* and 230*c*. Each row group contains an arbitrary number of rows (e.g., y) that are all associated with a particular row driver circuit; three respective row driver circuits are shown 220*a*–220*c*. In one embodiment of the present invention, there are over 400 rows (x=400) and therefore 400/y number of individual row groups 230 and associated row drivers 220. However, it is appreciated that the present invention is equally well suited to an FED flat panel display screen 200 having any number of rows.

Also shown in FIG. 3 are column groups 250*a*, 250*b*, 250*c* and 250*d* which in one embodiment are integrated circuits. In one embodiment of the present invention there are over 1920 columns to allow n=640 pixels (1920/3=640). A pixel requires three columns (red, green, blue), therefore, 1920 columns provides at least 640 pixel resolution horizontally. However, it is appreciated that the present invention is equally well suited to an FED flat panel display screen having any number of columns. Like row drivers 220, the column drivers 240 can be separated into multiple independent column drivers each responsible for driving a group of columns.

The Row Driver Circuits 220. Row driver circuits 220*a*–220*c* of FIG. 3 are preferably placed along the periphery of the substrate area FED flat panel display screen 200. In FIG. 3, only three row drivers are shown for clarity. As discussed, each row driver 220*a*–220*c* is responsible for driving a group of rows. For instance, row driver 220*a* drives rows 230*a*, row driver 220*b* drives rows 230*b* and row driver 220*c* drives rows 230*c*. Although an individual row driver is responsible for driving a group of rows, only one row is active (e.g., driven) at a time across the entire FED flat panel display screen 200. Therefore, any individual row driver circuit drives at most one row line at a time, and when the active row line is not in its group during a refresh cycle it is not driving any row line.

A supply voltage line 212 is coupled in parallel to all row drivers 220*a*–220*c* and supplies the row drivers with a driving voltage for application to the cathode 60/40 of the emitters. In one embodiment, the row driving voltage is negative in polarity, but could be positive in other embodiments. An enable signal is also supplied to each row driver 220*a*–220*c* in parallel over enable line 216 of FIG. 3. When the enable line 216 is low, all row drivers 220*a*–220*c* of FED screen 200 are disabled and no row is energized. When the enable line 216 is high, the row drivers 220*a*–220*c* are enabled.

A horizontal clock signal ("H SYNCH") is also supplied to each row driver 220*a*–220*c* of FIG. 3 in parallel over clock line 214 of FIG. 3. The horizontal clock signal 214 (or synchronization signal) pulses each time a new row is to be energized and marks the start of a row on-time window. The horizontal clock signal 214 also synchronizes the loading of new column color data into the column driver circuits 240. Therefore, the x rows of a display frame are energized, one at a time, with the columns receiving the respective data. When all rows have been energized, a frame of data is displayed. Assuming an exemplary frame update rate of 60 Hz, all rows are updated once every 16.67 milliseconds. Assuming x rows per frame update, the horizontal clock signal 214 pulses once every 16.67/x milliseconds. In other words a new row is energized every 16.67/n milliseconds. If x is 400, the horizontal clock signal 214 pulses once every 41.67 microseconds.

All row drivers of FED 200 are configured to implement one large serial shift register having x bits of storage, one bit per row. Row data is shifted through these row drivers using a row data line 212 that is coupled to the row drivers 220*a*–220*c* in serial fashion. During sequential frame update mode, all but one of the bits of the n bits within the row drivers contain a "0" and the other one contains a "1". Therefore, the "1" is shifted serially through all n rows, one at a time, from the upper most row to the bottom most row. Upon a given horizontal clock signal pulse, the row corresponding to the "1" is then driven for the on-time window. The bits of the shift registers are shifted through the row drivers 220*a*–220*c* once every pulse of the horizontal clock as provided by line 214. In interlace mode, the odd rows are updated in series followed by the even rows. A different bit pattern and clocking scheme is therefore used.

The row corresponding to the shifted "1" becomes driven responsive to the horizontal clock pulse over line 214. The row remains on during a particular "on-time" window. During this on-time window, the corresponding row is driven with the voltage value as seen over voltage supply line 212 provided the row drivers are also enabled. During the on-time window, the other rows are not driven with any voltage. In one embodiment, the rows are energized with a negative voltage, which could be a positive voltage in other embodiments.

The Column Driver Circuits 240. As shown by FIG. 4, there are three columns per pixel (or "white group") within the FED flat panel display screen 200 of the present invention. Column lines 250*a* of FIG. 3 control one column of pixels, column lines 250*b* control another column of pixels, etc. FIG. 3 also illustrates the column drivers 240 that control the gray-scale information for each pixel. In an analogous fashion to the row driver circuits, the column drivers 240 can be broken into separate circuits that each drive groups of column lines. In accordance with the present invention, the column drivers 240 drive time multiplexed, amplitude modulated, voltage signals over the column lines 250. The amplitude modulated voltage signals driven over the column lines 250*a*–250*e* represent gray-scale data for a respective row of pixels. The larger the effective voltage (EV) of the column voltage, the larger the light intensity of the corresponding color point. The lower the effective voltage (EV) of the column voltage, the lower the light intensity for the corresponding color point.

Once every pulse of the horizontal clock signal at line 214, the column drivers 240 receive gray-scale digital color data (clocked by line 205) to independently control all of the column lines 250*a*–250*e* of a pixel row of the FED flat panel display screen 200. Therefore, while only one row is energized per horizontal clock, all columns 250*a*–250*e* are energized during the row on-time window. The horizontal clock signal over line 214 synchronizes the loading of a pixel row of gray-scale data into the column drivers 240. Column drivers 240 receive column data over column data line 520 and column drivers 240 are also coupled in common to a number of voltage tap lines which are included within column voltage supply line 515.

Different voltages are applied to the column lines by the column drivers 240 to realize different gray-scale colors. In operation, all column lines are driven with gray-scale data (over column data line 520) and simultaneously one row is activated. This causes a row of pixels of illuminate with the proper gray-scale data. This is then repeated for another row, etc., once per pulse of the horizontal clock signal of line 214, until the entire frame is filled. To increase speed, while one row is being energized, the gray-scale data for the next pixel row is simultaneously loaded into the column drivers 240. Like the row drivers, 220*a*–220*c* the column drivers assert their voltages within the on-time window. Further, like the row drivers 220*a*–220*c*, the column drivers 240 have an enable line. In one embodiment, the columns are energized with a positive voltage.

Multiplexing Column Voltages. As discussed more fully below, the present invention time multiplexes certain column voltages during the row on-time window to alter the color balance of the FED flat panel display screen 200 of FIG. 3. Specifically, to increase the color intensity for a particular color, the effective column voltages for that color (e.g., applied to all n columns of that color) are increased during the row on-time window. To decrease the color intensity for a particular color, the effective column voltages for that color (e.g., applied to all n columns of that color) are decreased during the row on-time window. Since the color data of the column drivers are not altered during color balancing, the present invention does not significantly degrade gray-scale resolution by altering color balancing in the above fashion.

The following describes the mechanisms used by embodiments of the present invention for providing dynamic color balance adjustment within the framework of an FED screen 200 as described above.

Color Balance Control Circuitry of the Present Invention

As described more fully below, the present invention provides a mechanism for uniformly increasing or decreasing the effective voltages applied from the column drivers, of a particular color, in order to perform color balancing on that color. Each color can be adjusted separately and simultaneously. More specifically, the present invention provides a mechanism for uniformly increasing or decreasing the effective voltage applied during the row on-time window by all red (or green or blue) column drivers by a particular percentage to increase or decrease, respectively, the intensity of the red (or green or blue) spots uniformly over the FED screen 200.

In accordance with the present invention, the effective voltage applied is adjusted by time multiplexing two different column voltages over the row on-time window. In one embodiment, a full column voltage is applied during a first part of the row on-time window and a second or "half" column voltage is then applied over a second part of the row on-time window. The effective voltage then applied over the row-time window is the weighted average of the two voltages (full and half) weighted in accordance with the lengths of the first and second parts, respectively. The lengths of the first and second parts of the row on-time window are the same for a given color but can vary from color to color. In this way, color balancing is applied uniformly with respect to a given color.

Figure 5:
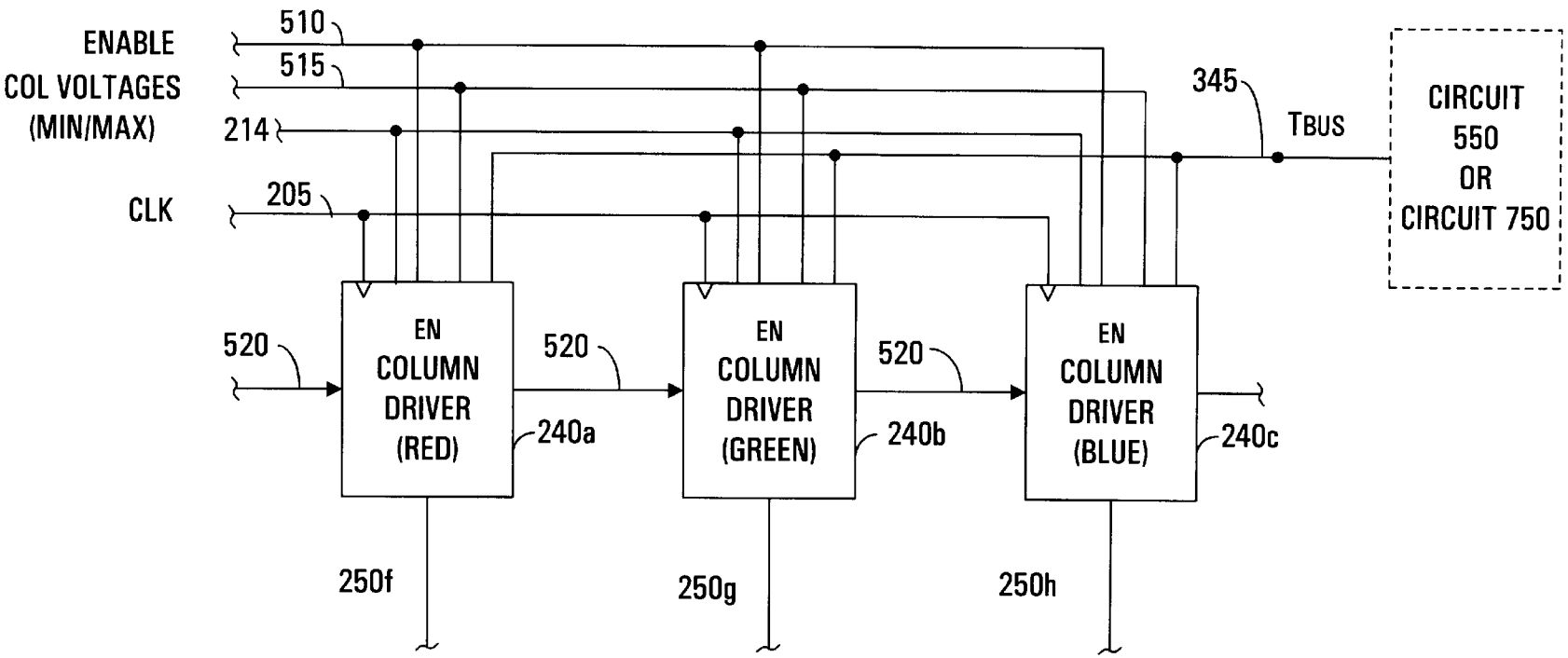
FIG. 5 is an illustration of three exemplary column drivers (red/green/blue) of the flat panel FED screen of the present invention.

FIG. 5 illustrates three separate and exemplary column drivers 240*a*–240*c* of FED flat panel display screen 200 that drive exemplary column lines 250*f*–250*h*, respectively. These three column lines 250*f*–250*h* correspond to the red, green and blue lines of a vertically aligned column of pixels (also called a column of white groups). Gray-scale information is supplied over data bus 520 as digital color data to the column drivers 240*a*–240*c* and is clocked in by clock 205. The gray-scale information causes the column drivers to assert different voltage amplitudes to realize the different gray-scale contents of the pixel. Different gray-scale data for a row of pixels are presented to the column drivers 240*a*–240*c* for each pulse of the horizontal clock signal 214. As discussed more fully below, the present invention provides a mechanism for adjusting the color balance of a pixel by controlling circuitry within each column driver, e.g., 240*a*, 240*b* and 250*c*.

In one embodiment, the digital color data is presented to each column driver in a seven bit word but could alternatively be presented using only six bits, or any number of bits. Each column driver 240*a*–240*c* of FIG. 5 also has an enable input that is coupled to enable line 510 which is supplied in parallel to each column driver 240*a*–240*c*. Each column driver 240*a*–240*c* is coupled to a column voltage line 515 which includes voltage tap lines that originate from a resistor chain. These voltage tap lines are coupled to digital to analog converter circuits located within each column driver, e.g., 240*a*, 240*b* and 250*c*. The column drivers 240*a*–240*c* also receive a column clock signal 205 for clocking in the gray-scale data for a particular row of pixels. A timing bus 345 includes a red timing signal 345*a*, a green timing signal 345*b* and a blue timing signal 345*c* used by the present invention. Bus 345 is generated by timing circuit 550 (FIG. 11) in the first and second embodiments of the present invention and generated by timing circuit 750 (FIG. 14) in the third embodiment.

In accordance with the present invention, the color intensity of all color spots of the FED screen 200 of a particular color can be adjusted to perform color balancing. Adjustments to the color balance can be performed in response to FED screen aging or to manufacturing variations of the phosphors within the FED screen 200. Alternatively, adjustments to the color balance can be performed by the viewer based on individual viewing taste. The following describes the circuitry used by the first, second and third embodiments of the present invention for altering the color intensity of each color spot of a particular color within the frame work of the FED screen 200.

Circuit Overview

Figure 6:
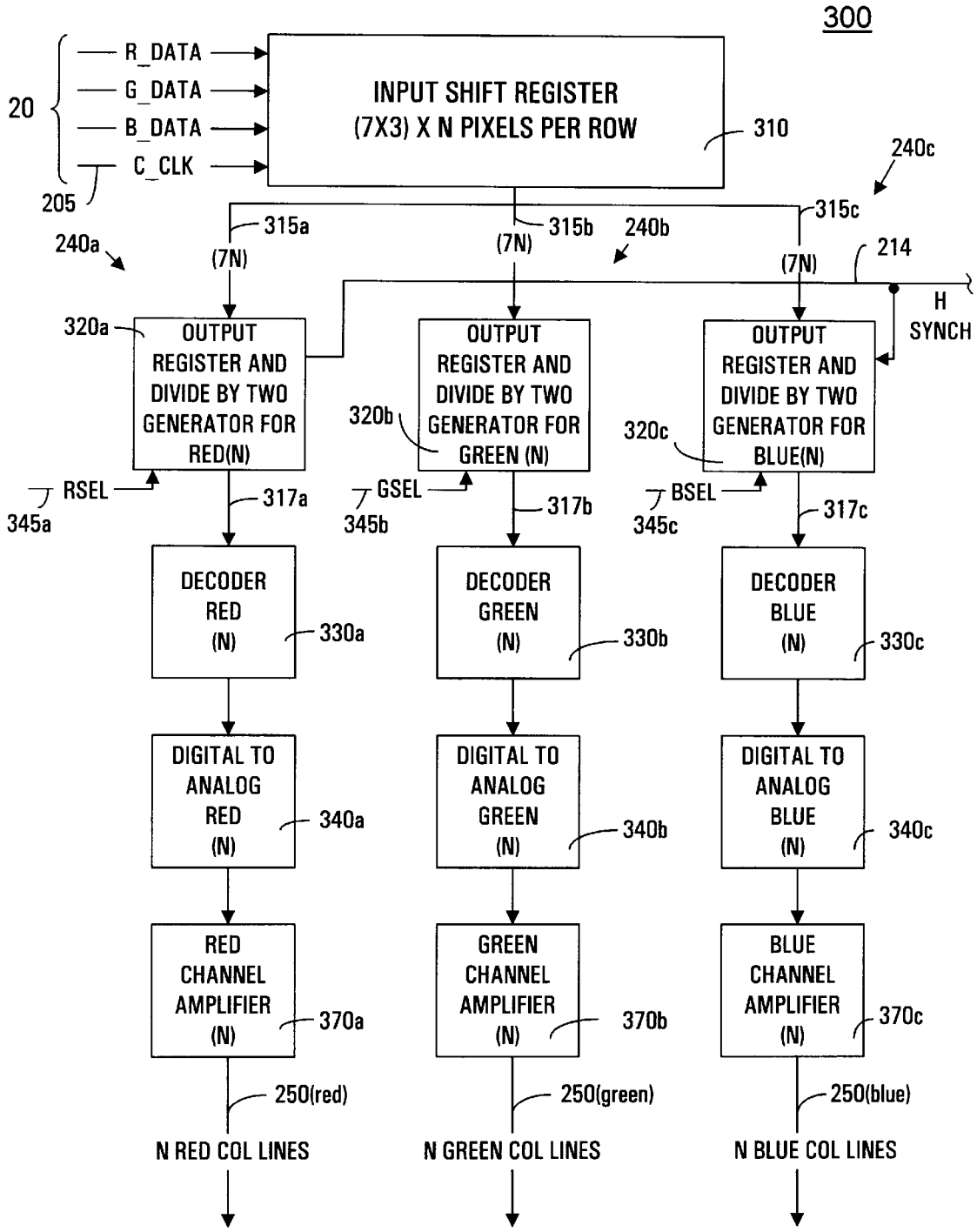
FIG. 6 is an overall block diagram of a circuit of the present invention for the time multiplexed application of column voltages for color balancing.

FIG. 6 illustrates a block diagram of a circuit 300 in accordance with the present invention for performing dynamic adjustments to the color balance of an FED screen 200. Within circuit 300, digital color data, over bus 520, representing a complete row of image data, including red data, green data and blue data, is serially clocked into multiple (e.g., 3n) shift registers 310. The process of loading the above data is initiated by the horizontal synchronization clock 214. Clock signal 205 is the column clock signal and operates at a frequency sufficient to load all digital color data for a row of pixels within the period of successive horizontal clock signal pulses of line 214.

Assuming FED screen 200 contains n pixels along the vertical, there are 3n column drivers in the FED screen 200. More specifically, there are n number of blue column drivers and, for a given row of image data, each blue column driver receives an individual digital blue data. There are n number of red column drivers and, for a given row of image data, each red column driver receives an individual digital red data. Likewise, there are n number of green column drivers and, for a given row of image data, each green column driver receives an individual digital green data. Each color data, in one embodiment, is seven bits wide. Therefore, shift register 310 of FIG. 6 actually represents 3n individual shift registers with each shift register (within each column driver) receiving seven bits of digital color data. Since a pixel requires one red, one green and one blue color, a pixel of color data requires 7×3 color bits.

Blocks 320*a*–370*a* of FIG. 6 represent the circuitry required to drive red color data over the red column lines and also to perform color balancing for the n number of red column drivers 240*a* to uniformly alter the red color across the FED 200 according to a signal, RSEL 345*a*. Blocks 320*b*–370*b* represent the circuitry required to drive green color data over the green column lines and also to perform color balancing for the n number of green column drivers 240*b* to uniformly alter the green color across the FED 200 according to a signal, GSEL 345*b*. Lastly, Blocks 330*c*–370*c* represent the circuitry required to drive blue color data over the blue column lines and also to perform color balancing for the n number of blue column drivers 240*c* to uniformly alter the blue color across the FED 200 according to a signal, BSEL 345*c*.

The horizontal synchronization signal 214 latches in a row of image data from bus 315 into 3n output registers 320*a*–320*c* that also contain divide by two circuitry in accordance with the present invention. Bus 315*a* represents all of the red color data of the row of image data and, in one embodiment, this comprises n number of 7-bit data which are input to n circuits 320*a* for red. Bus 315*b* represents all of the green color data of the row of image data and, in one embodiment, this comprises n number of 7-bit data which are input to n circuits 320*b* for green. Bus 315*c* represents all of the blue color data of the row of image data and, in one embodiment, this comprises n number of 7-bit data which are input to n circuits 320*c* for blue.

Circuits 320*a* of FIG. 6 are responsible for presenting n separate digital values representing n first column voltages over n separate red buses 317*a* during a first part of the row on-time window and is also responsible for then presenting n separate digital values representing n second column voltages (e.g., half of the first column voltages) over the n separate red buses 317*a* during a second part of the row on-time window. The relative lengths of the first and second parts being defined by the RSEL signal over line 340*a*. The RSEL signal 345*a* is applied uniformly to all n red circuits 320*a*. In this fashion, the red timing signal 345*a* is used for all red column drivers to control the intervals over which analog voltages are time multiplexed over the individual red column lines 250(red). Circuits 320*b* perform analogous functions for the n green column buses 317*b* and the relative lengths of the first and second parts for these circuits 320*b* are defined by the GSEL signal of line 345*b* which is applied uniformly to all n green circuits 320*b*. Circuits 320*c* perform an analogous function for the n blue column buses 317*c* and the relative lengths of the first and second parts for these circuits 320*c* are defined by the BSEL signal of line 345*c* which is applied uniformly to all n blue circuits 320*c*.

Block 330*a* of FIG. 6 represents n decoders, one for each red column driver. Each decoder receives a different digital red color data from buses 317*a*. In one embodiment, six of the 7 bits of color data are used by the decoders 330*a* to determine one of 64 different red color values for each red column driver. In another embodiment, 7 bits of color data produce 128 different red color values. Block 340*a* of FIG. 6 represents n digital to analog converters, one for each red column driver. In accordance with the present invention, each digital to analog converter of each red column driver contains an analog switch circuit that receives its corresponding red color data value. The analog switch circuit is coupled to the above referenced tap lines and maintains a data-in voltage-out function and thereby generates an analog voltage output. The data-in voltage-out function determines a particular column voltage based on the input color data. The column voltage in turn translates to a particular color intensity for red.

Block 370*a* of FIG. 6 represents n channel amplifiers 370*a*, one for each of the n red column drivers. Each channel amplifier receives an analog voltage from its corresponding digital to analog converter circuit of 340*a* and asserts this signal over its corresponding red column line. In the aggregate, n column outputs 250(red) are individually generated simultaneously by block 370*a*. As discussed above, block 320*a*, block 330*a*, block 340*a* and block 370*a* represent circuitry that is duplicated and therefore distributed within each red column driver 240*a* of FED screen 200.

Circuit blocks 320*b*, 330*b*, 340*b* and 370*b* of FIG. 6 are analogous to blocks 320*a*, 330*a*, 340*a* and 370*a*, but cover the n circuits that apply to the n green column drivers and alter the green color to affect color balancing. A green timing signal (GSEL) 345*b* is used for all green column drivers to control the time multiplexing of the column voltage signals over the individual green column lines 250(green). Therefore, block 320*b*, block 330*b*, block 340*b* and block 370*b* represent circuitry that is duplicated and distributed within each green column driver 240*b* of FED screen 200. Likewise, circuit blocks 320*c*, 330*c*, 340*c* and 370*c* of FIG. 6 are analogous to blocks 320*a*, 330*a*, 340*a* and 370*a*, but cover the n circuits that apply to the n blue column drivers and alter the blue color to affect color balancing. A blue timing signal (BSEL) 345*c* is used for all blue column drivers to control the time multiplexing of the column voltage signals over the individual blue column lines 250 (blue). Therefore, block 320*c*, block 330*c*, block 340*c* and block 370*c* represent circuitry that is duplicated and distributed within each blue column driver 240*c* of FED screen 200.

Figure 7:
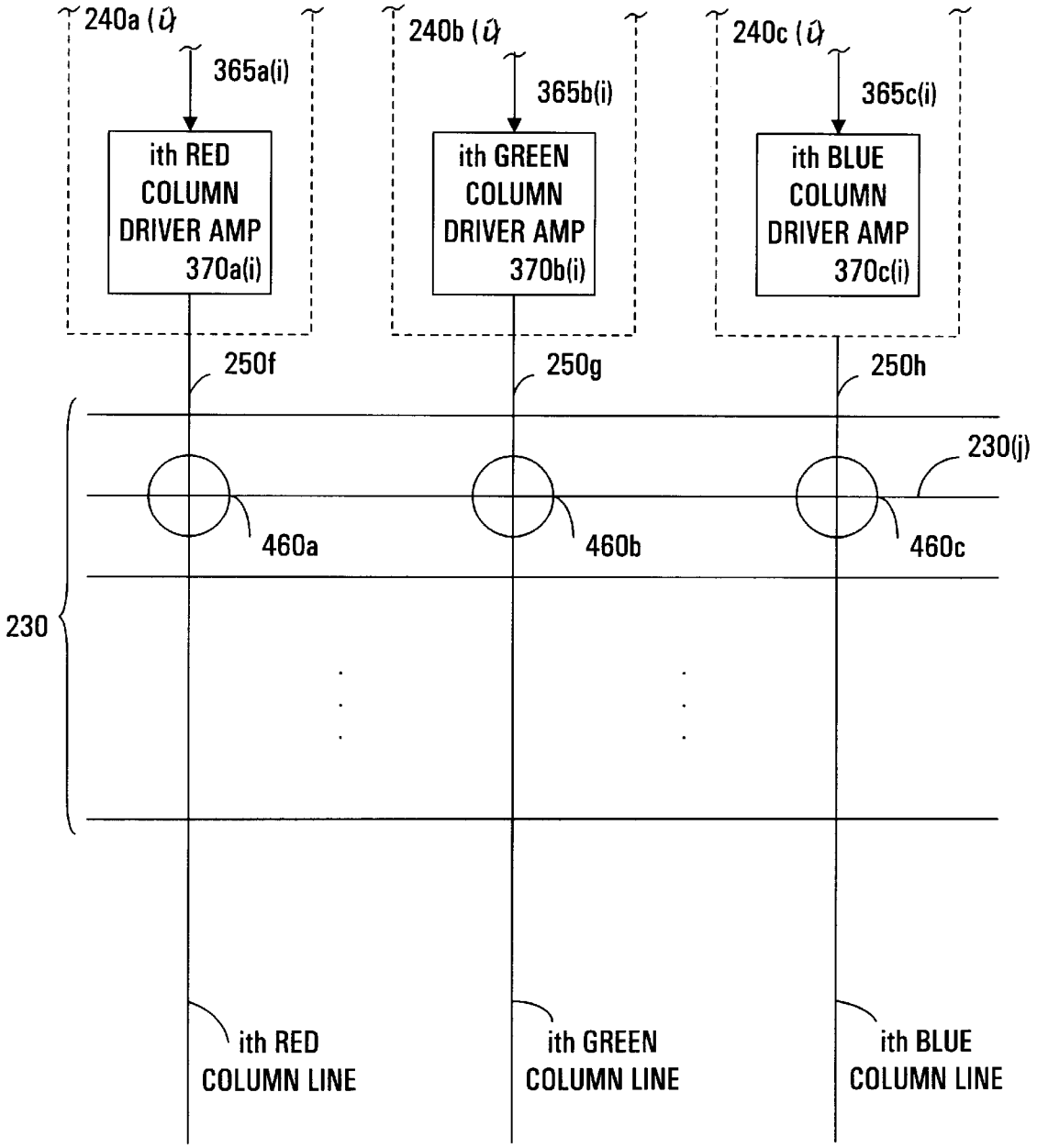
FIG. 7 illustrates the red, green and blue column driver amplifier circuits of an exemplary ith white pixel group in accordance with the present invention.

FIG. 7 partially illustrates the circuitry within three exemplary column drivers 240*a*(i), 240*b*(i) and 240*c*(i) that control the ith pixel column of FED screen 200. Specifically, only the driver amplifier circuits 370*a*(i), 370*b*(i) and 370*c* (i) are illustrated. The remainder of the column driver circuitry for these column drivers 240*a*(i), 240*b*(i) and 240*c*(i) is shown in FIG. 8A, FIG. 8B and FIG. 8C, respectively.

FIG. 7 illustrates that the amplifier circuits 370*a*(i), 370*b* (i) and 370*c*(i) are directly coupled to receive the outputs from lines 365*a*(i), 365*b*(i) and 365*c*(i), respectively, and drive their respective column lines with these voltage levels. When row 230*j* (e.g., the ith row) is active, column driver 240*a*(i) drives a column voltage over ith red column line 250*f* to illuminate the ith red spot 460*a*; column driver 240*b*(i) drives a column voltage over ith green column line 250*g* to illuminate the ith green spot 460*b*; and column driver 240*c*(i) drives a column voltage over ith blue column line 250*h* to illuminate the ith blue spot 460*c*. It is appreciated that the red spot 460*a*, the green spot 460*b* and the blue spot 460*c* comprise the ith pixel for a given row, e.g., row 230*j*.

Figure 8A:
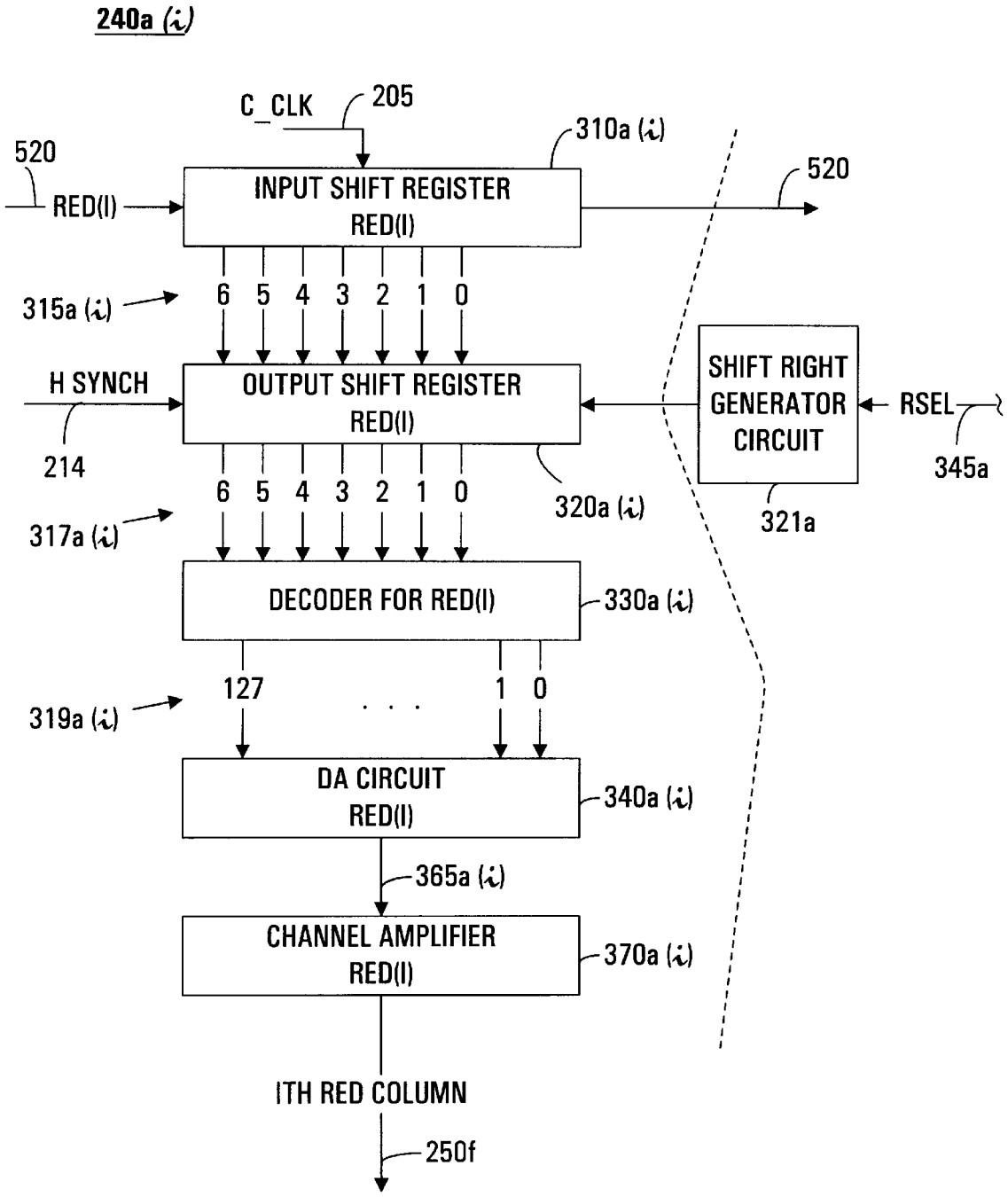
FIG. 8A is a circuit diagram of color balance adjustment circuitry used by a first embodiment the present invention in an exemplary ith red column driver for driving the ith red column line.
Figure 8B:
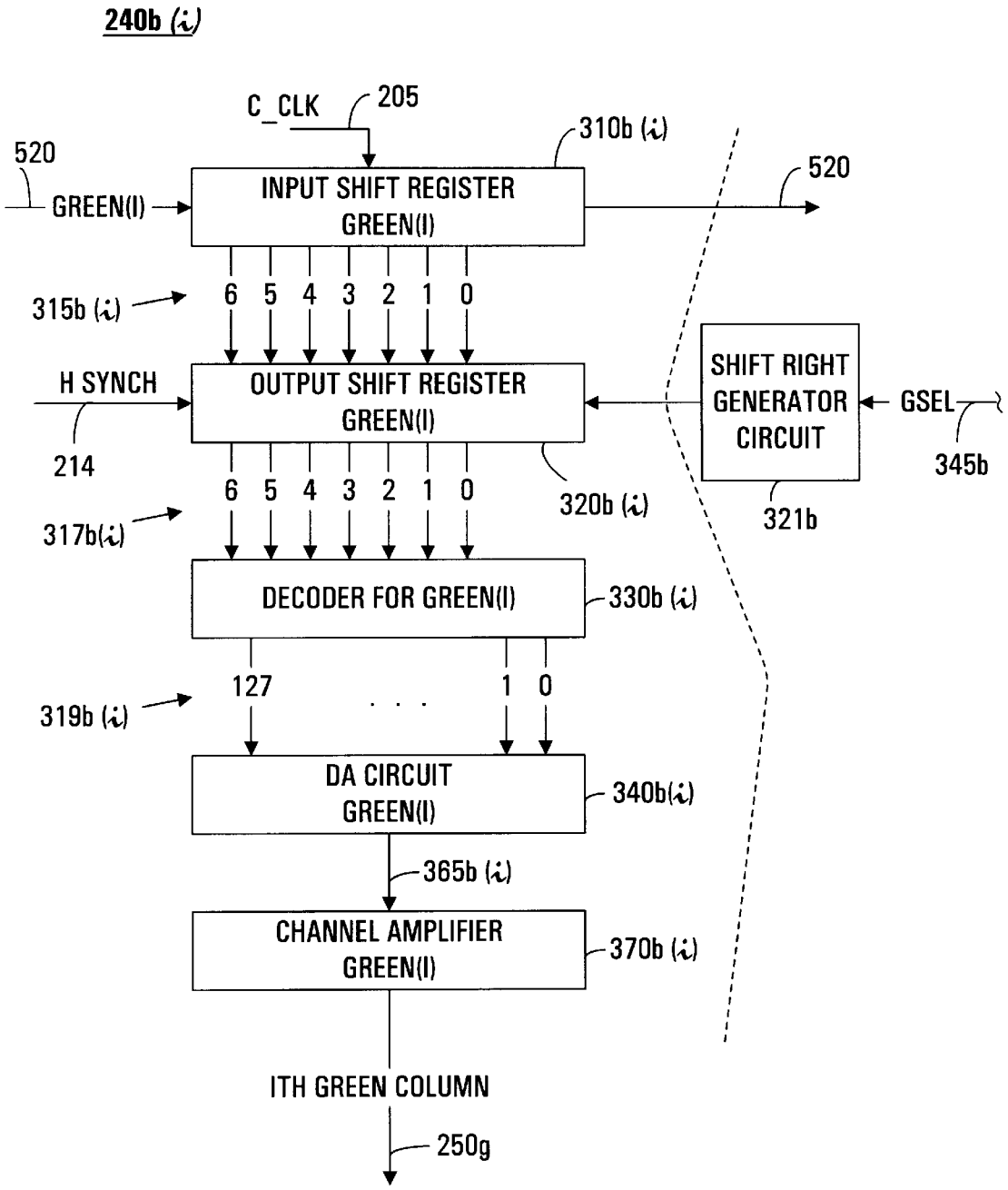
FIG. 8B is a circuit diagram of color balance adjustment circuitry used by the first embodiment of the present invention in an exemplary ith green column driver for driving the ith green column line.
Figure 8C:
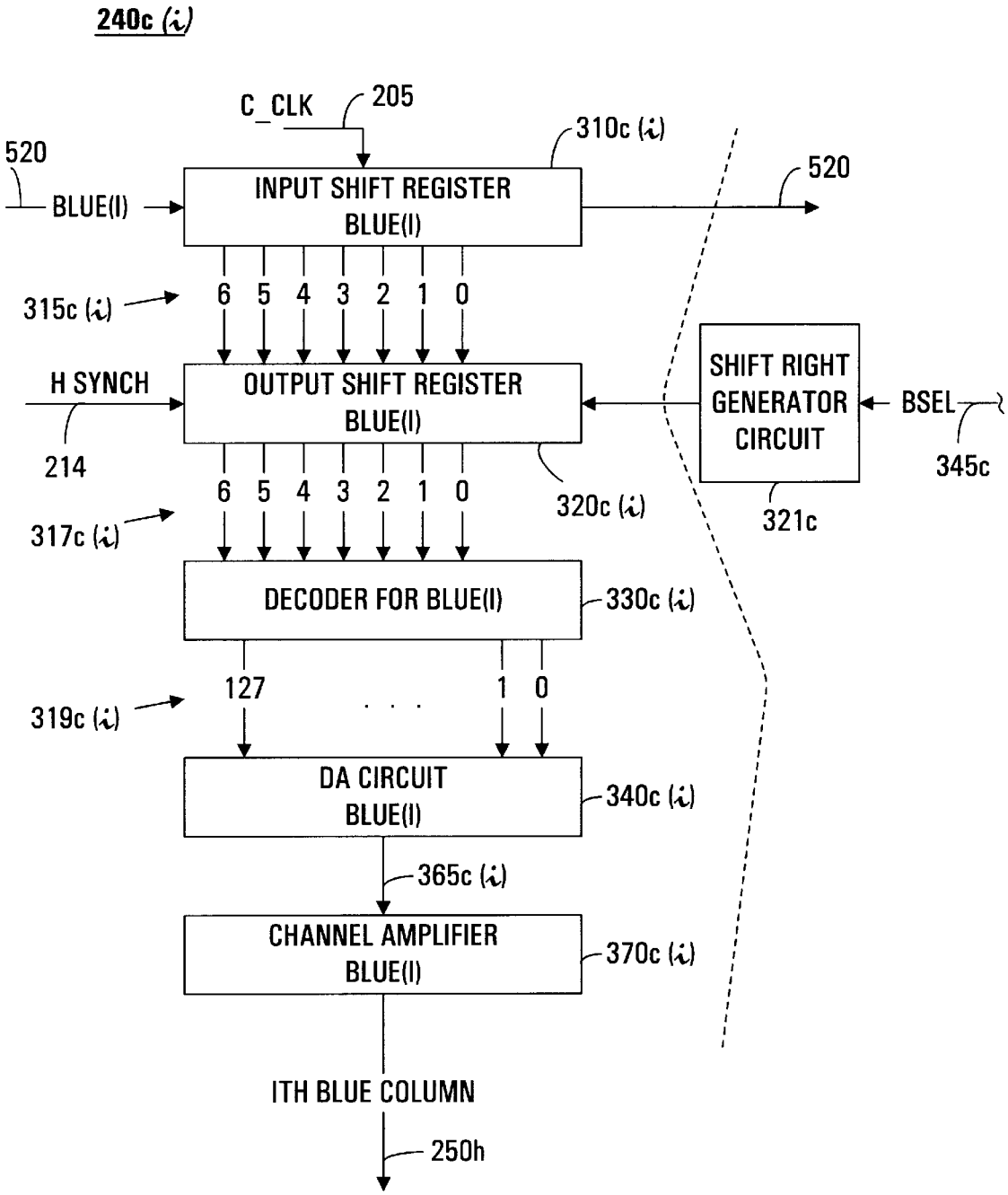
FIG. 8C is a circuit diagram of color balance adjustment circuitry used by the first embodiment of the present invention in an exemplary ith blue column driver for driving the ith blue column line.

Output Register Having Divide by Two Function for Time Multiplexing Column Voltages over Row-on Time FIG. 8A, FIG. 8B and FIG. 8C illustrate the circuitry used by a first embodiment of the present invention for adjusting color balance within an FED screen 200 for three exemplary column drivers: the ith red column driver 240*a*(i) of the n red column drivers 240*a*, the ith green column driver 240*b*(i) of the n green column drivers 240*b* and the ith blue column driver 240*c*(i) of the n blue column drivers 240*c*. These three exemplary ith column drivers provide the column voltage signals for the ith pixel along a given row of pixels during a first part and a second part of the row on-time window. The first embodiment uses an output shift right register to perform a divide by two function, described below, to generate the voltages applied during the first and second parts.

Components with FIGS. 8A, 8B and 8C that have the "(i)" designation are replicated for each of the n column drivers of the same color as the exemplary column driver, (i), to which they are described. Components without the "(i)" designation are not replicated within each column driver but rather are shared by all column drivers, or all column drivers of a similar color, as described more particularly below.

FIG. 8A illustrates circuitry within the exemplary red column driver 240*a*(i) that drives the ith red column (250*f* of FIG. 7) within the ith pixel (of the n horizontal pixels) of the FED screen 200. Prior to the next pulse of the horizontal synchronization signal 214, the input shift register 310*a*(i) serially receives (over bus 520) one seven bit color data value for the red intensity of the ith pixel of a row (e.g., row j). This data is clocked in based on signal 205. On the next pulse of horizontal synchronization signal 214, a new row on-time window starts. When a new row on-time window starts, the "first voltage" data from the input register 310*a*(i) is then loaded in parallel to the output shift register 320*a*(i) over the lines of bus 315*a*(i). The first voltage data is held in shift register 320*a*(i), and output over lines of bus 317*a*(i), until a pulse is received from the shift right generator circuit 321*a*. One circuit 321*a* is coupled to and used by all of the n red column drivers 240*a*. Circuit 321*a* is coupled to receive the RSEL signal 345*a* and according to the present invention generates a pulse to the output shift register 320*a*(i) when the RSEL signal 345*a* transitions.

When the pulse is received from circuit 321*a* of FIG. 8A, the output shift register 320*a*(i) of the present invention serially shifts its bit contents by one bit position to the right, effectively performing a divide by two operation on the first voltage data. During the right shift operation, a zero bit is inserted into the left most bit position (e.g., the MSB). The resulting digital value, a six bit "second voltage" data, represents half of the "first voltage" data and is held on lines 317*a*(i) until the start of the next row on-time window (e.g., until the next pulse of line 214).

The data bits (either of the first or the second voltage data) are forwarded over bus 317*a*(i) in parallel to decoder circuit 330*a*(i) which in response generates a signal over a single output line of bus 319*a*(i). If seven bits of color data are used, then decoder circuit 330*a*(i) is a 0 to 127 decoder (as shown). Alternatively, if six bits of color data are used, then decoder circuit 330*a*(i) is a 0 to 63 decoder. For a given input over bus 317*a*(i), the decoder circuit 330*a*(i) generates a single active signal over one of the lines of bus 319*a*(i) to the digital to analog ("DA") voltage converter circuit 340*a*(i). Since the first and second voltage data are presented, time multiplexed, within a given row on-time window, decoder circuit 330*a*(i) generates two separate time multiplexed outputs to the DA voltage circuit 340*a*(i) during the row on-time window.

The DA voltage circuit 340*a*(i) of FIG. 8A contains a function of switches that can provide any transformation function (e.g., linear or non-linear) depending on the programmed configuration of certain internal switches coupled to a resistor chain which is coupled to the previously described voltage taps. This is described in more detail in co-pending U.S. Patent Application entitled, "A Circuit and Method for Controlling the Color Balance of a Flat Panel Display Without Reducing Gray Scale Resolution," filed Sep. 25, 1997, Ser. No. 08/938,194, by Hansen, et. al., and incorporated herein by reference. Using its transformation function, the DA voltage circuit 340*a*(i) generates, over line 365*a*(i), a first analog voltage corresponding to the first voltage data. Subsequently, DA voltage circuit 340*a*(i) generates a second analog voltage corresponding to the second voltage data. The channel amplifier circuit 370*a*(i) receives these time multiplexed analog voltage signals over line 365*a*(i) and drives these values over the ith red column line 250*f* as appropriate.

Figure 11:
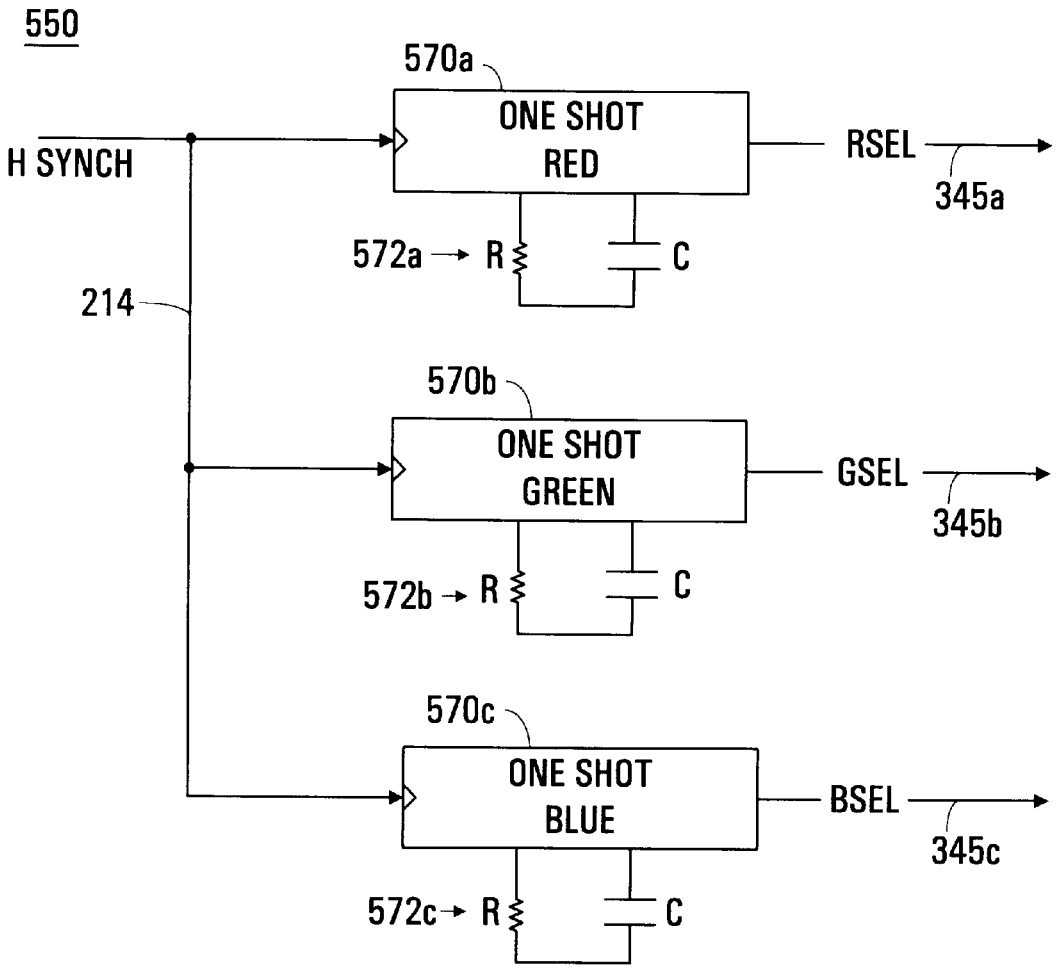
FIG. 11 illustrates circuitry for generating red, green and blue selection signals used by the first and second embodiments of the present invention for performing color balancing.

It is appreciated that circuit 321*a*, signal 345*a*, the horizontal synchronization signal 214, the clock signal 205 and column data bus 520 are used by all of the n red column driver circuits 240*a* of the present invention. The mechanism for generating the RSEL signal 345*a* in accordance with the present invention is described further below (FIG. 11).

FIG. 8B illustrates circuitry with an exemplary green column driver 240*b*(i) that drives the ith green column line 250*g* (FIG. 7) for the ith pixel (of the n horizontal pixels) of the FED screen 200. The circuitry of FIG. 8B, although replicated for and pertinent to the ith green column driver 240*b*(i), is analogous to the circuitry of FIG. 8A except a green color data value is received over bus 520 for the ith pixel and the row on-time window is time multiplexed according to a GSEL line 345*b*, not the RSEL line 345*a*. Also, a different shift right generator circuit 321*b* is used for the green columns. It is appreciated that circuit 321*b*, signal 345*b*, the horizontal synchronization signal 214, the clock signal 205 and column data bus 520 are used by all of the n green column driver circuits 240*b* of the present invention. The mechanism for generating the GSEL signal 345*b* in accordance with the present invention is described further below.

As discussed with reference to FIG. 8A, the output shift register 320*b*(i) generates two different green voltage data values, a first and a second, which are time multiplexed and fed to decoder 330*b*(i). The channel amplifier 370*b*(i) therefore generates two different time multiplexed green analog voltage signals over column line 250*g*. The time multiplexing for green is controlled by the GSEL line 345*b*.

FIG. 8C illustrates circuitry with an exemplary blue column driver 240*c*(i) that drives the ith blue column line 250*h* (FIG. 7) for the ith pixel (of the n horizontal pixels) of the FED screen 200. The circuitry of FIG. 8C, although replicated for and pertinent to the ith blue column driver 240*c*(i), is analogous to the circuitry of FIG. 8A except a blue color data value is received over bus 520 for the ith pixel and the row on-time window is time multiplexed according to a BSEL line 345*c*, not the RSEL line 345*a*. Also, a different shift right generator circuit 321*c* is used for the blue columns. It is appreciated that circuit 321*c*, signal 345*c*, the horizontal synchronization signal 214, the clock signal 205 and column data bus 520 are used by all of the n blue column driver circuits 240*c* of the present invention. The mechanism for generating the BSEL signal 345*c* in accordance with the present invention is described further below.

As discussed with reference to FIG. 8A, the output shift register 320*c*(i) generates two different blue voltage data values, a first and a second, which are time multiplexed and fed to decoder 330*c*(i). The channel amplifier 370*c*(i) therefore generates two different time multiplexed blue analog voltage signals over column line 250*h*. The time multiplexing for blue is controlled by the BSEL line 345*c*.

Figure 9A:
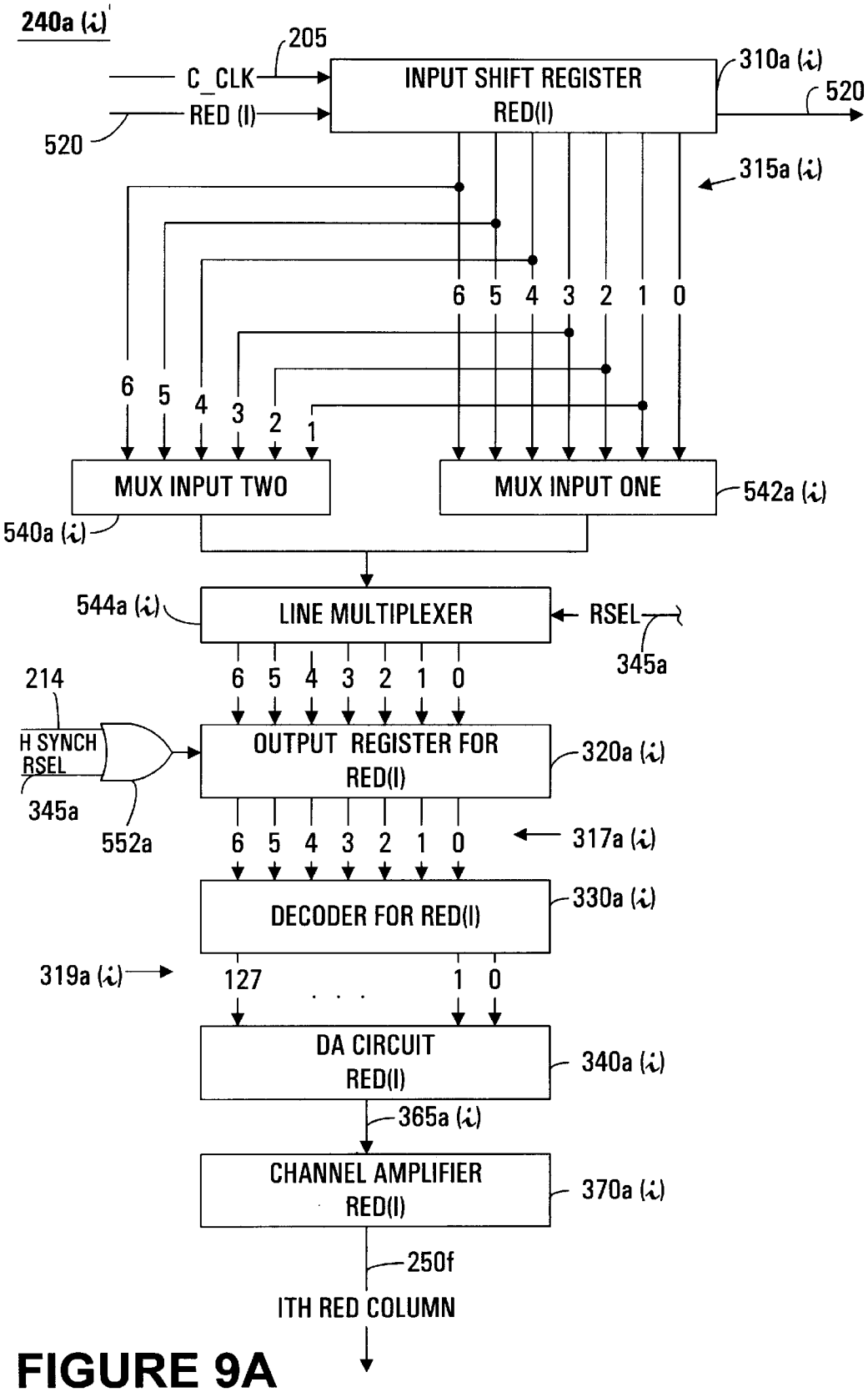
FIG. 9A is a circuit diagram of color balance adjustment circuitry used by a second embodiment the present invention in an exemplary ith red column driver for driving the ith red column line.
Figure 9B:
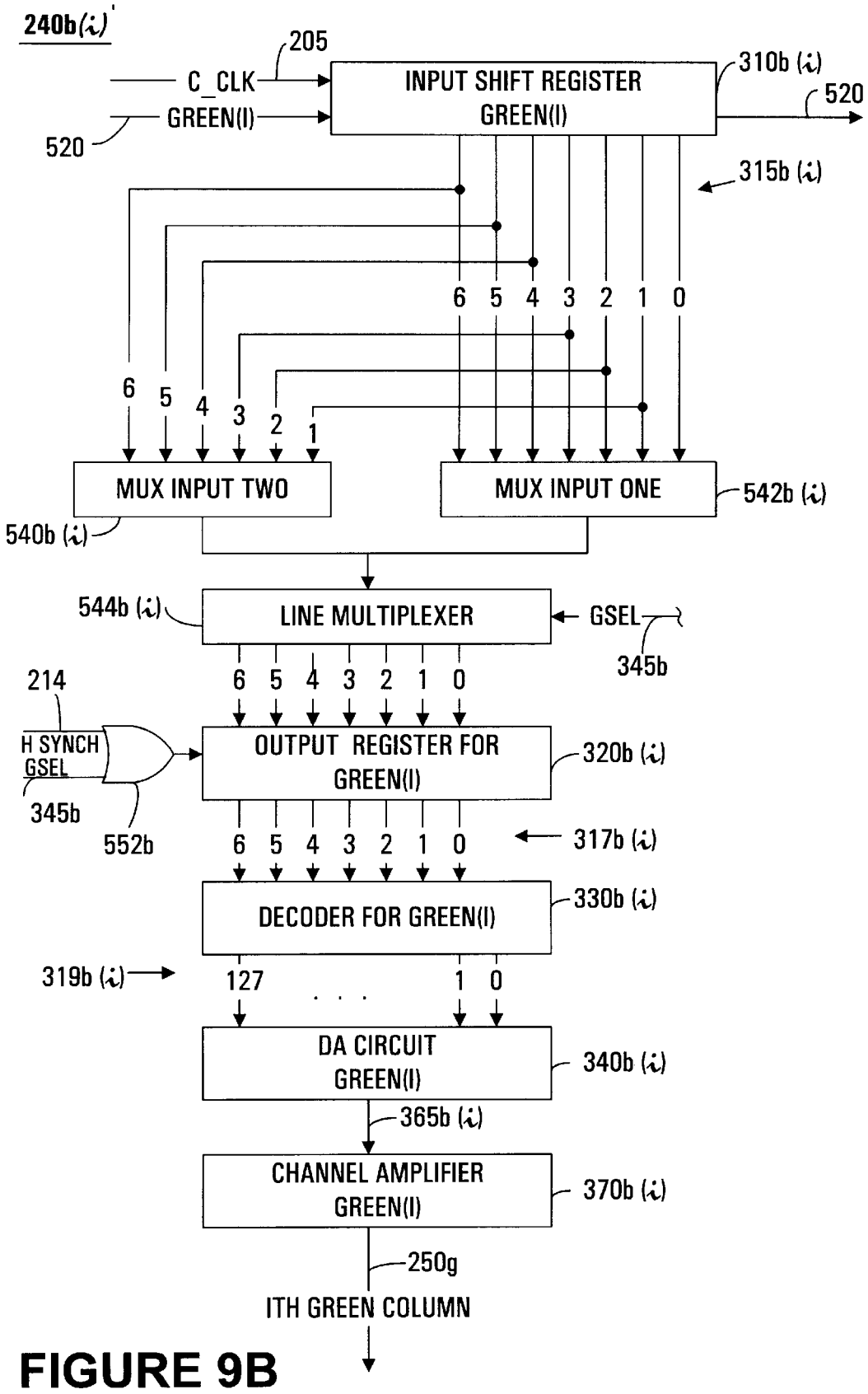
FIG. 9B is a circuit diagram of color balance adjustment circuitry used by the second embodiment of the present invention in an exemplary ith green column driver for driving the ith green column line.
Figure 9C:
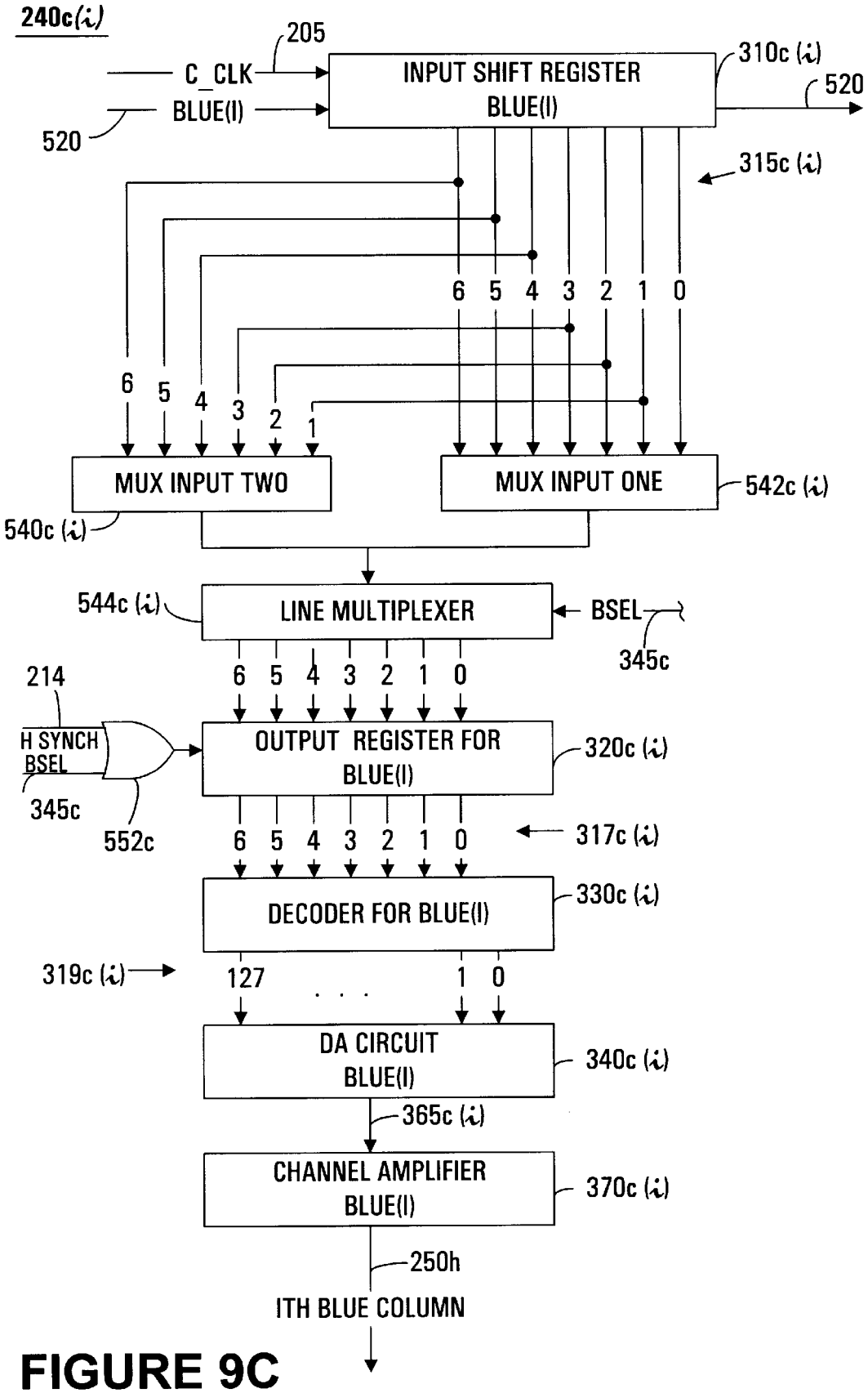
FIG. 9C is a circuit diagram of color balance adjustment circuitry used by the second embodiment of the present invention in an exemplary ith blue column driver for driving the ith blue column line.

FIG. 9A, FIG. 9B and FIG. 9C illustrate the circuitry used by a second embodiment of the present invention for adjusting color balance within an FED screen 200 for three exemplary column drivers: the ith red column driver 240*a*(i)' of the n red column drivers 240*a*, the ith green column driver 240*b*(i)' of the n green column drivers 240*b* and the ith blue column driver 240*c*(i)' of the n blue column drivers 240*c*. These three exemplary ith column drivers represent the ith pixel along a given row of pixels. The second embodiment uses a multiplexer configuration, rather than a shift register, to perform the divide by two function, described below. Components with FIGS. 9A, 9B and 9C that have the "(i)" designation are replicated for each column driver of the same color as the exemplary column driver to which they are described. Components without the "(i)" designation are not replicated within each column driver but rather are shared by all column drivers, or all column drivers of a similar color, as described more particularly below.

FIG. 9A illustrates circuitry within the exemplary red column driver 240*a*(i)' that drives the ith red column (250*f* of FIG. 7) within the ith pixel (of the n horizontal pixels) of the FED screen 200. Prior to the next pulse of the horizontal synchronization signal 214, the input shift register 310*a*(i) serially receives (over bus 520) one seven bit color data value for the red intensity of the ith pixel of a row (e.g., row j). This data is clocked in based on signal 205. On the next pulse of horizontal synchronization signal 214, a new row on-time window starts. When a new row on-time window starts, the "first voltage" data from the input register 310*a*(i) is then loaded in parallel onto lines 0 to 6 of bus 315*a*(i). Lines 0 to 6 of bus 315*a*(i) are coupled to one input 542*a*(i) of multiplexer 544*a*(i). Lines 1 to 6 are coupled to a second input 540*a*(i) of multiplexer 544*a*(i) starting from the (LSB0) position. This digitally provides that the value represented by input 540*a*(i) is half of the value represented by input 542*a*(i).

In accordance with the second embodiment of the present invention, the first input 542*a*(i) contains the first red voltage data and the second input 540*a*(i) contains the second red voltage data. The RSEL line 345*a* is used as a selection control on mux 544*a*(i) such that mux input one 542*a*(i) is first provided to the output register 320*a*(i) and latched in according to signal 214. Then, when RSEL 345*a* transitions, mux input two 540*a*(i) is then provided to the output register 320*a*(i) and latched in according to signal 345*a*. The OR gate 522*a*, used for all of the n red driver circuits, receives both signals 214 and 345*a* to provide the latching function for output register 320*a*(i). Circuits 330*a*(i), 340*a*(i) and 370*a*(i) operate in a fashion analogous to FIG. 8A to drive time multiplexed voltage signals over the ith red column 250*f*. As seen, column driver 240*a*(i)' is analogous to column driver 240*a*(i) of FIG. 8A except a multiplexing circuit is used to provide the divide by two function rather than a shift register.

It is appreciated that circuit 522*a*, signal 345*a*, the horizontal synchronization signal 214, the clock signal 205 and column data bus 520 are used by all of the n red column driver circuits of the second embodiment of the present invention.

FIG. 9B illustrates circuitry with an exemplary green column driver 240*b*(i)' that drives the ith green column line 250*g* (FIG. 7) for the ith pixel (of the n horizontal pixels) of the FED screen 200. The circuitry of FIG. 9B, although replicated for and pertinent to the ith green column driver 240*b*(i)', is analogous to the circuitry of FIG. 9A except a green color data value is received over bus 520 for the ith pixel and the row on-time window is time multiplexed according to a GSEL line 345*b*, not the RSEL line 345*a*. Also, a different OR gate circuit 522*b* is used. It is appreciated that circuit 522*b*, signal 345*b*, the horizontal synchronization signal 214, the clock signal 205 and column data bus 520 are used by all of the n green column driver circuits of the second embodiment of the present invention. The channel amplifier 370*b*(i) generates two different time multiplexed green voltage signals over column line 250*g*. The time multiplexing for green is controlled by the GSEL line 345*b*.

FIG. 9C illustrates circuitry with an exemplary blue column driver 240*b*(i)' that drives the ith blue column line 250*h* (FIG. 7) for the ith pixel (of the n horizontal pixels) of the FED screen 200. The circuitry of FIG. 9C, although replicated for and pertinent to the ith blue column driver 240*c*(i)', is analogous to the circuitry of FIG. 9A except a blue color data value is received over bus 520 for the ith pixel and the row on-time window is time multiplexed according to a BSEL line 345*c*, not the RSEL line 345*a*. Also, a different OR gate circuit 522*c* is used. It is appreciated that circuit 522*c*, signal 345*c*, the horizontal synchronization signal 214, the clock signal 205 and column data bus 520 are used by all of the n blue column driver circuits of the second embodiment of the present invention. The channel amplifier 370*c*(i) therefore generates two different time multiplexed blue voltage signals over column line 250*h*. The time multiplexing for blue is controlled by the BSEL line 345*c*.

Figure 10:
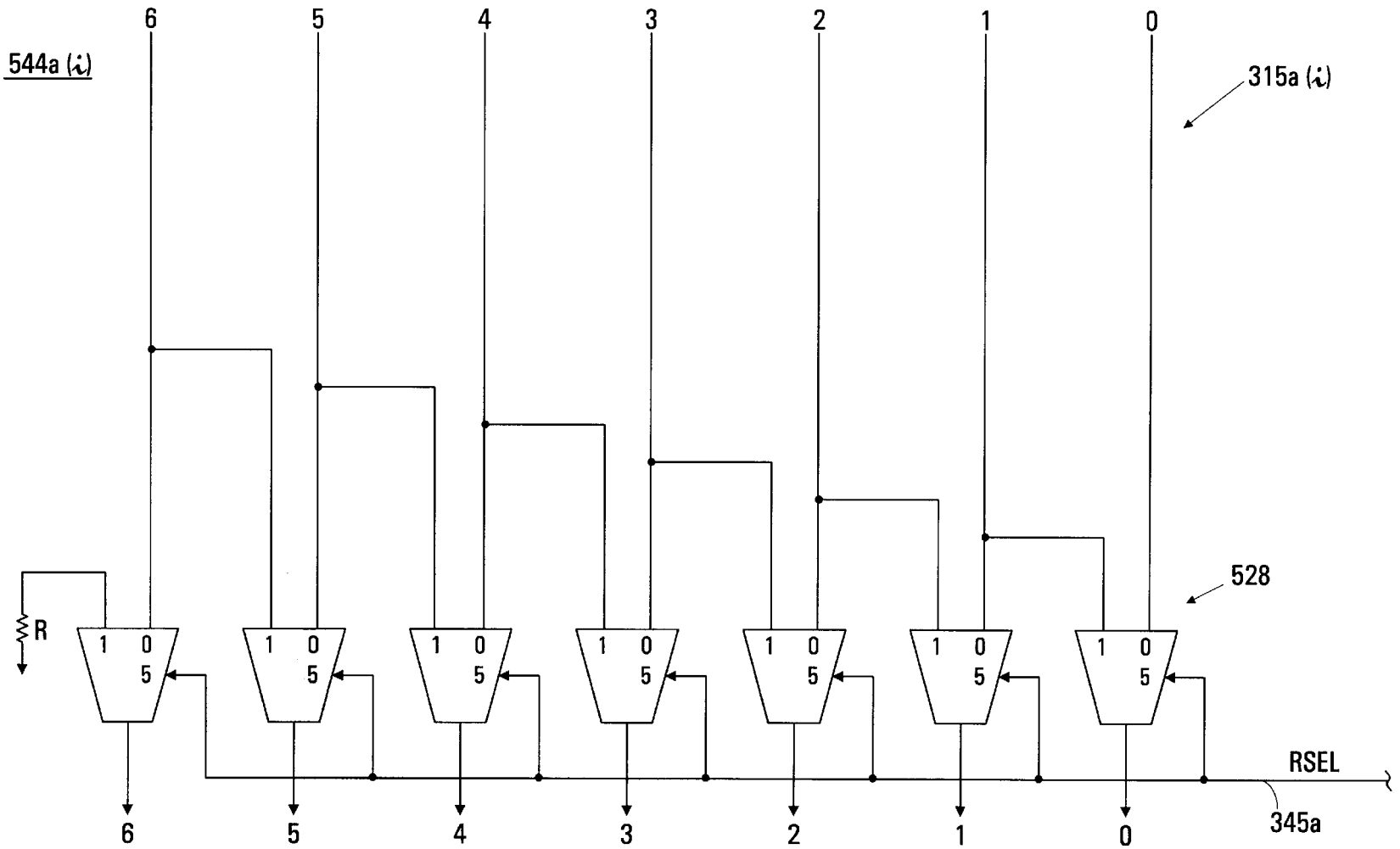
FIG. 10 illustrates a multiplexing circuit used by the second embodiment of the present invention to perform color balancing.

FIG. 10 illustrates an exemplary configuration for realizing the multiplexer 544*a*(i), first input 542*a*(i) and second input 540*a*(i) of FIG. 9A. In this configuration, the lines of bus 315*a*(i) are coupled to the inputs of seven two-input multiplexers 528 having select inputs which are all controlled by line 345*a*. The inputs to these two-input multiplexers 528 are configured as shown in FIG. 10 to provide for the first voltage and its divided-by-two second voltage value. The outputs 530 are then provided to the output shift register 320*a*(i).

FIG. 11 illustrates one timing circuit 550 for generating the signals of the RSEL line 345*a*, the GSEL line 345*b* and the BSEL line 345*c*. Circuit 550 can be used in the first and second embodiments of the present invention described above. In circuit 550, three separate one-shot circuits 570*a*–570*c* are provided. Each one-shot circuit 570 contains its own separate user-adjustable resistor-capacitor network 572*a*–572*c* to vary the period of each output signal. The one-shot circuits 570*a*–570*c* are all clocked by the horizontal synchronization signal 214. Circuit 550 provides separate and programmable signals for RSEL 345*a*, GSEL 345*b* and BSEL 345*c* so that the red, green and blue components of the pixels of FED screen 200 can be adjusted independently for color balance.

Figure 12A:
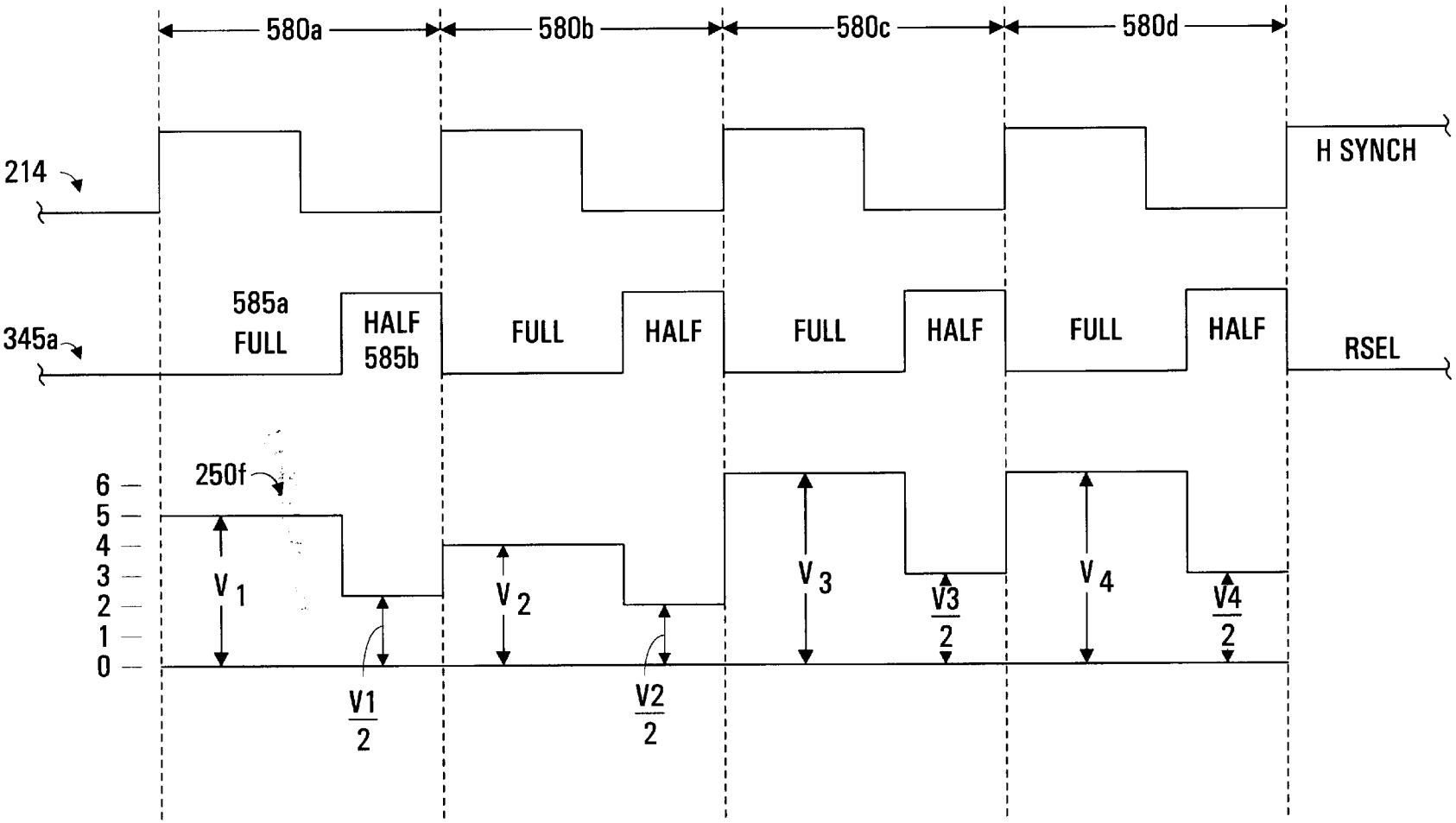
FIG. 12A illustrates timing diagrams of the relevant signals used by the first and second color balancing embodiments of the present invention for an exemplary color, e.g., red.

FIG. 12A illustrates timing diagrams of the pertinent signals used by the first and second embodiments of the present invention for the exemplary red column driver 240*a*(i) of FIG. 8A and for the exemplary column driver 240*a*(i)' of FIG. 9A. The horizontal synchronization clock 214 is shown divided into four exemplary consecutive row on-time windows 580*a*–580*d*. Row on-time windows 580*a*–580*d* correspond to the sequential activation of four adjacent rows of FED 200. At the start of a row-on time window 580*a*, a designated row receives an enabling voltage level while the other rows are disabled. Before the start of the row on-time window 580*a*, the digital color data for all columns of this row have been loaded into each respective column driver.

The RSEL signal 345*a* of FIG. 12A divides each row on-time window 580 into two parts, a first part which presents the first or "full" voltage data and a second part which presents the second or "half" voltage data. (In one alternate embodiment, the half voltage data is gauged such that half current is drawn.) Also shown in FIG. 12A is the analog voltage signal driven on the ith column line 250*f* for producing light intensity at red color spot 460*a* (FIG. 7). For example, during row on-time window 580*a* of FIG. 12A, first voltage v1 is driven during the first part 585*a* and second, or half, voltage (v1/2) is driven during the second part 585*b* of row on-time window 580*a*. The relative lengths of first part 585*a* and second part 585*b* can be adjusted by adjusting the resistor-capacitor network 572*a* (FIG. 11). The effective voltage amplitude, VE, for window 580*a* is therefore the weighted average of v1 and (v1/2) over their respective on-time parts 585*a*–585*b* according to:

$$VE=[(V1*L585a)+((V1/2)*L585b)]/[L585a+L585b]$$

where L585a is the length of row on-time first part 585*a* and L585b is the length of row on-time second part 585*b*. Likewise, for row on-time 580*b*, voltages v2 and (v2/2) are driven as shown. For row on-time 580*c*, voltages v3 and (v3/2) are driven as shown and for row on-time 580*d*, voltages v4 and (v4/2) are driven as shown.

Figure 12B:
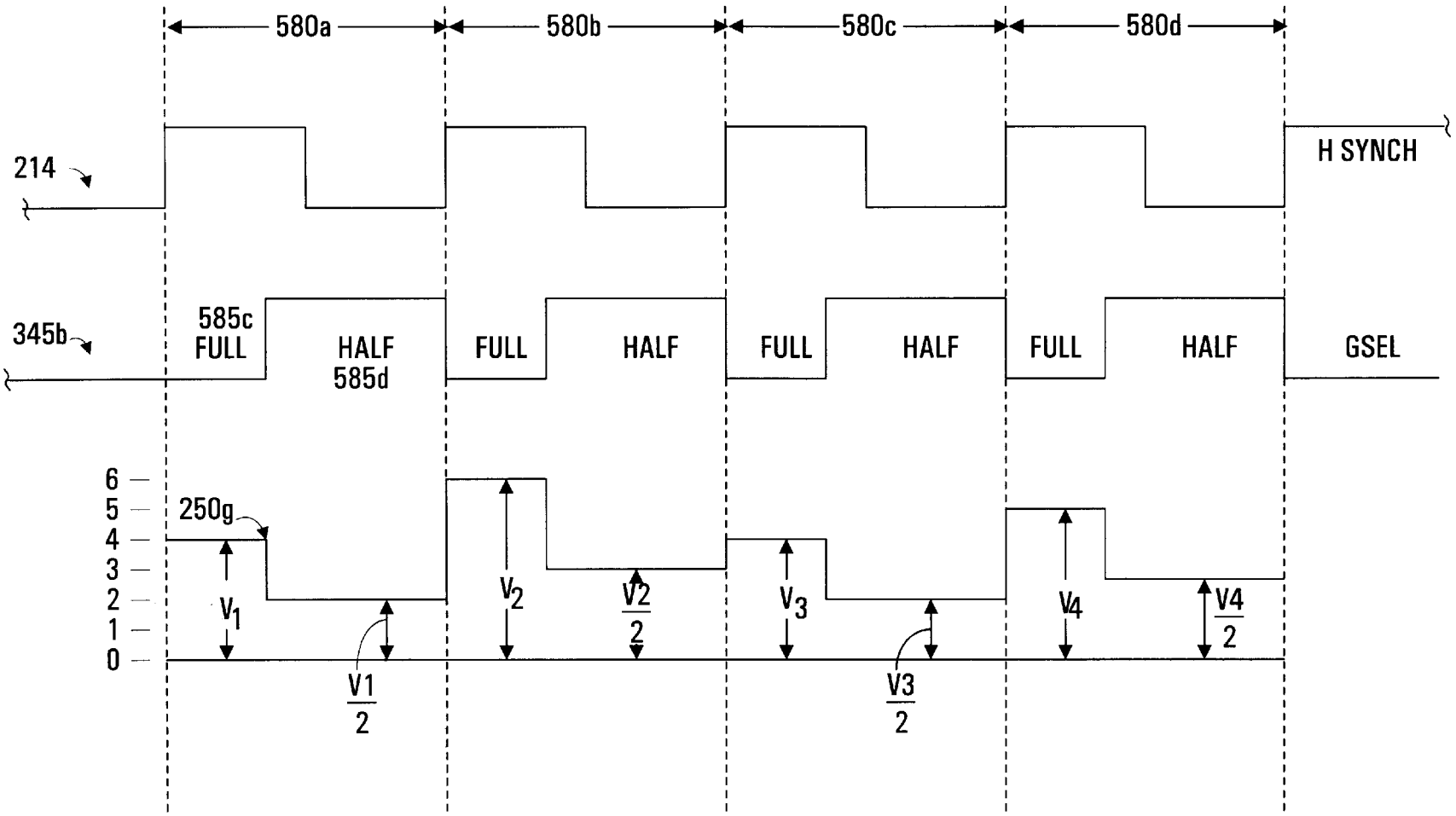
FIG. 12B illustrates timing diagrams of the relevant signals used by the first and second color balancing embodiments of the present invention for an exemplary color, e.g., green.

FIG. 12B illustrates timing diagrams of the pertinent signals used by the first and second embodiments of the present invention for the exemplary green column driver 240*b*(i) of FIG. 8B and for the exemplary column driver 240*b*(i)' of FIG. 9B. The horizontal synchronization clock 214 is shown divided into the four exemplary consecutive row on-time windows 580*a*–580*d* of FIG. 12A. The GSEL signal 345*b* divides each row on-time window 580 into two parts, a first part which presents the first or "full" voltage data and a second part which presents the second or "half" voltage data. Also shown in FIG. 12B is the analog voltage signal driven on the ith column line 250*g* for producing light intensity at green color spot 460*b* (FIG. 7). For example, during row on-time window 580*a* of FIG. 12B, voltage v1 is driven during the first part 585*c* and half voltage (v1/2) is driven during the second part 585*d* of row on-time window 580*a*. The relative lengths of first part 585*c* and second part 585*d* can be adjusted by adjusting the resistor-capacitor network 572*b* (FIG. 11). Likewise, for row on-time 580*b*, voltages v2 and (v2/2) are driven as shown. For row on-time 580*c*, voltages v3 and (v3/2) are driven as shown and f or row on-time 580*d*, voltages v4 and (v4/2) are driven as shown. It is appreciated that V1–V4 of FIG. 12A are not the same voltage values as V1–V4 of FIG. 12B.

According to the teachings above, the color balance of the first and second embodiments of the present invention can be adjusted by varying the RSEL signal 345*a*, the GSEL signal 345*b* and the BSEL signal 345*c* according to the circuit 550 of FIG. 11. The red component of the current color balance can be increased by altering RSEL signal 345*a* such that the first part of the row on-time window that corresponds to the red color is increased. This increases the period in which the first or "full" voltage is applied. Since the red timing pulse RSEL 345A is applied to all red column drivers 240*a*, they will uniformly adjust up the respective effective column voltages which are used to generate the red color intensities. Although each red column driver receives different red color data, all red color intensities will be uniformly increased by the same amount. Likewise, the red component of the current color balance can be decreased by altering RSEL signal 345*a* such that the second part of the row on-time window that corresponds to the red color is increased. This increases the period in which the second or "half" voltage is applied. The same is true with respect to the green and blue color components which can be altered by similarly altering the GSEL 345*b* and the BSEL 345*c*, respectively.

Power Savings Third Embodiment of the Present Invention

As shown in FIG. 12A and FIG. 12B, the first and second parts of the row on-time windows 580*a*–580*d* occur in sequential and alternating order, e.g., the first or "full" part always following the second or "half" part which follows a first part, etc. Although effective to provide color balancing, this alternating scheme of the first and second embodiments of the present invention generates some frequency of voltage change with respect to the voltage signals driven on the columns (e.g., columns 250*f* and 250*g*). For instance, every full analog voltage level is followed by its half voltage level which is followed again by a full voltage of a next row-on time window, and so on.

The third embodiment of the present invention provides a mechanism for altering the order of the first and second parts of a row on-time window to decrease the overall frequency of voltage change on the columns while still providing for the same level of color balance functionality provided by the first and second embodiments of the present invention. Specifically, the third embodiment of the present invention provides a mechanisms whereby, for the period of two consecutive row on-time windows, two consecutive full parts are followed by two consecutive half parts. In other words, the order of the first ("FULL") and second ("HALF") parts of the row on-time window, compared to the first and second embodiments, are swapped for every other row on-time window. The result produces the following ordering within the third embodiment:

. . . FULL1 HALF1 HALF2 FULL2 FULL3 HALF3 HALF4 FULL4 . . .

rather than:

. . . FULL1 HALF1 FULL2 HALF2 FULL3 HALF3 FULL4 HALF4 . . .

which is produced by the first and second embodiments.

Figure 13:
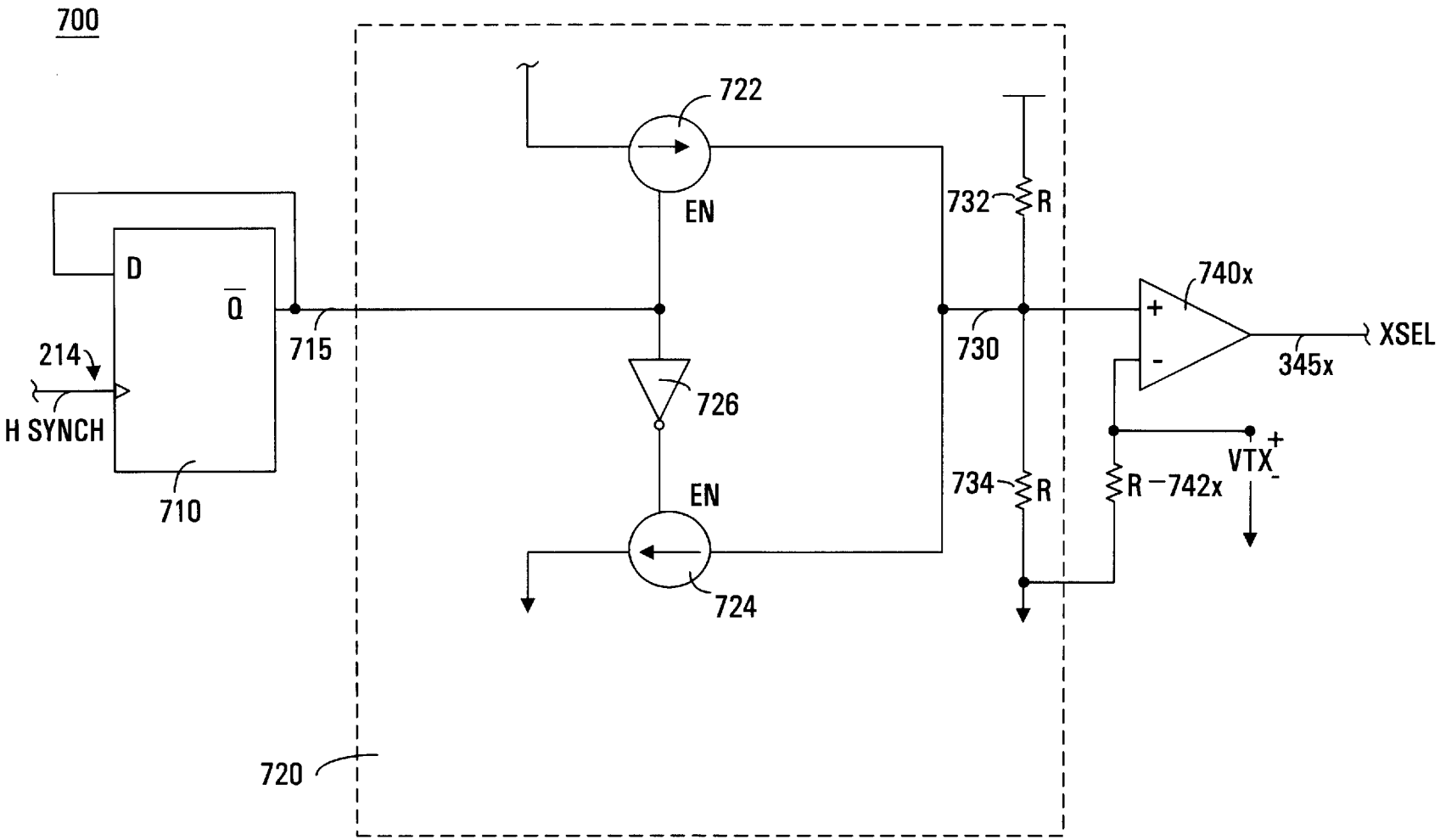
FIG. 13 illustrates a ramp generator circuit used by a third embodiment of the present invention for generating timing signals for time multiplexing voltage signals for one color.

FIG. 13 illustrates a circuit 700 used by the third embodiment of the present invention for providing the proper color select signals to realize the above ordering of full and half parts. Specifically, circuit 700 can be used to generate either signal 345*a*, 345*b* or 345*c*, any one of which is represented by the reference "345*x*" and "XSEL."

Circuit 700 includes a divide-by-two circuit 710 which receives the horizontal synchronization signal 214 and divides its frequency by two to produce a "HALF H SYNCH" signal at node 715. Any of a number of well known divide-by-two circuits can be used and the configured D flip-flop 710 shown in FIG. 13 is exemplary only. The HALF H SYNCH signal of node 715 controls a ramp generator circuit 720. Specifically, the signal at node 715 controls the enable line of a charging constant current source 722 and the inverse of the signal at node 715 (via inverter 726) controls the enable of a discharging constant current source 724. The charging constant current source 722 is coupled to a voltage source Vcc, and coupled to node 730. Node 730 is coupled to the discharging constant current source 724 which is coupled to ground or a negative voltage supply Vpp.

Node 730 of FIG. 13 is also coupled to a resistor 732 which is coupled to Vcc. Node 730 is coupled to a resistor 734 which is coupled to Vpp. Node 730 is also provided as the positive input of a comparator 740x. The negative input of comparator 740*x* is coupled to receive a threshold voltage VTX which is coupled to a resistor 742*x* which is coupled to Vpp. When the voltage at 730 is greater than the threshold voltage VTX, a signal is asserted over line 345*x*, otherwise, the signal line 345*x* is not asserted. By altering the threshold voltage VTX, the signal 345*x* is altered and therefore the relative lengths of the first and second parts of the row on-time window are also altered.

Figure 14:
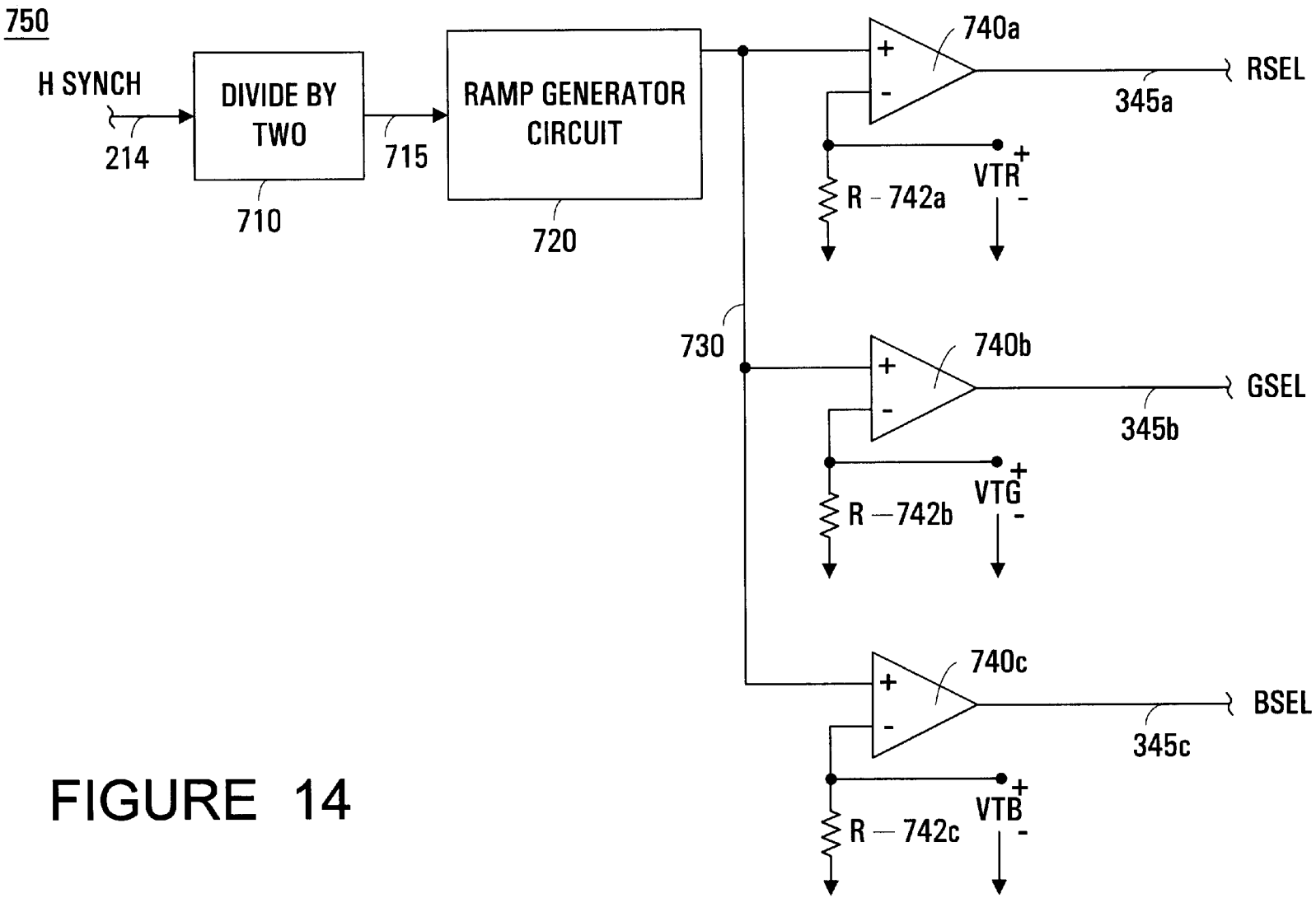
FIG. 14 illustrates a ramp generator circuit used by a third embodiment of the present invention for generating timing signals for time multiplexing voltage signals for red, green and blue colors.

FIG. 14 illustrates a timing circuit 750 that can be used to generate each of the RSEL 345*a*, the GSEL 345*b* and BSEL 345*c* signals based on three separate input threshold voltages, VTR, VTG and VTB, respectively, for red, green and blue. These signals, VTR, VTG and VTB, are user programmable based on desired a color balance and can be generated using a number of well known methods and components. The horizontal synchronization signal 214 is provided to a single divide-by-two circuit 710. The divided frequency signal is provided at 715 to a single ramp generator circuit 720.

The ramp signal 730 generated by the ramp signal generator 720 is provided to the positive input of three comparator circuits 740*a*, 740*b* and 740*c*. Each comparator circuit of 740*a*–740*c* also, at its negative input, receives a separate threshold voltage VTR for red, VTG for green and VTB for blue. Comparator circuit 740*a* then generates RSEL 345*a*, comparator circuit 740*b* generates GSEL 345*b* and comparator circuit 740*c* generates BSEL 345*c*. In accordance with the third embodiment of the present invention, the signals 345*a*–345*c* are then respectively coupled to the column driver circuits 240*a*–240*c* as shown in FIG. 6, FIGS. 8A–8C and FIGS. 9A–9C.

Figure 15:
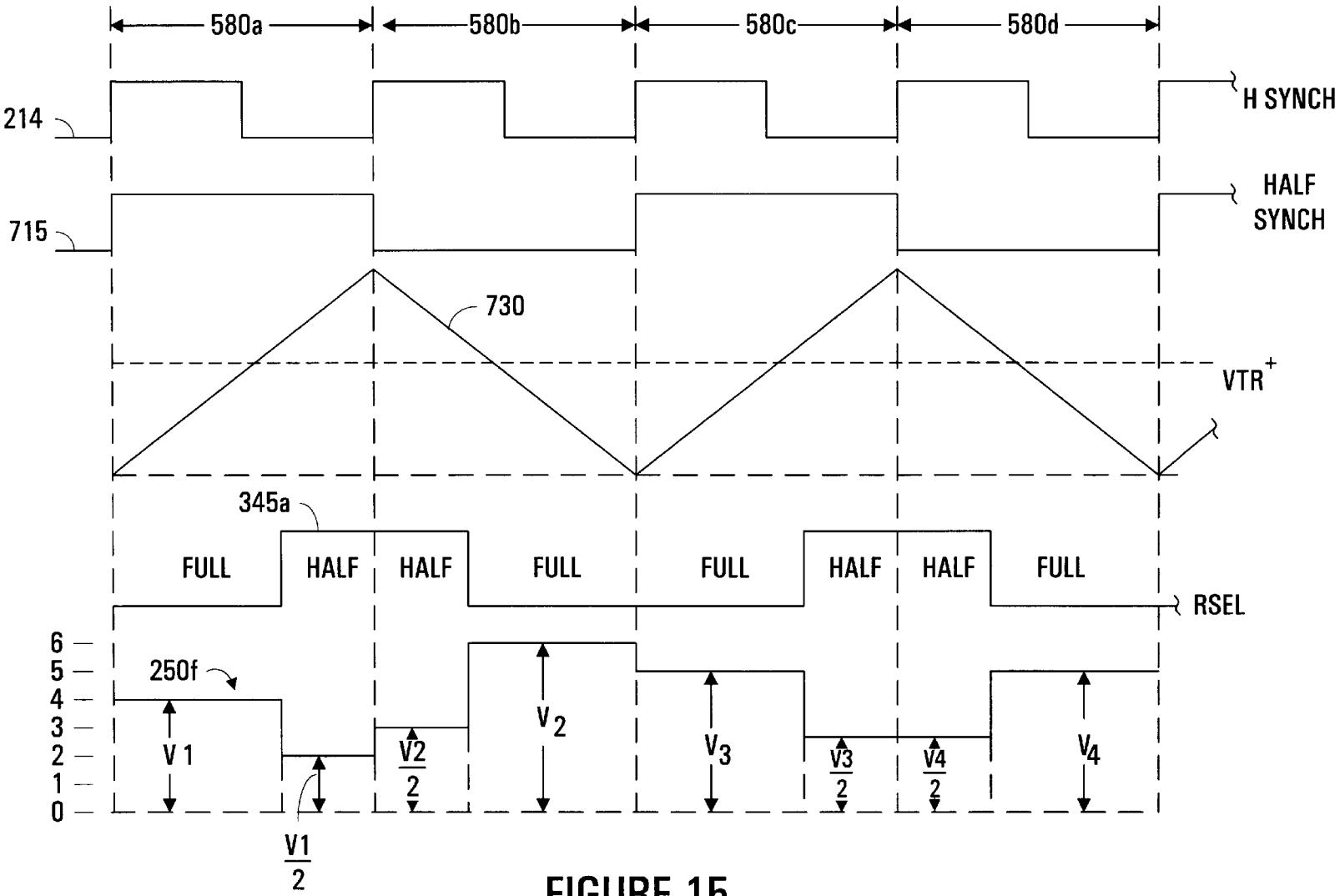
FIG. 15 illustrates timing diagrams of the relevant signals used by the third color balancing embodiment of the present invention for an exemplary color, e.g., red.

FIG. 15 illustrates timing diagrams of the pertinent signals used by the third embodiment of the present invention for the exemplary red column driver 240*a*(i)' of FIG. 9A. (In order for the exemplary red column driver 240*a*(i) to operate with the third embodiment, the driver would need to be modified such the output shift register 320*a*(i) was able to simultaneously supply both the first or "full" voltage data and the second or "half" voltage data.) The horizontal synchronization clock 214 is shown divided into four exemplary consecutive row on-time windows 580*a*–580*d*. The HALF H SYNCH signal 715 is also shown. During the first row-on time window 580*a*, the ramp signal 730 is charging, during the second row-on time window 580*b*, the ramp signal 730 is discharging. This sequence continues over windows 580*c* and 580*d*.

Although shown as analog, the ramp generator circuit 750 could also be implemented using digital circuits. In this digital implementation, the charging of node 730 can be simulated by upcounting a counter circuit and the discharging of node 730 can be simulated by downcounting the counter circuit wherein signal 715 controls the count direction. In this implementation, a digital comparator is used for circuit 740*x* and the threshold value VTX would be a digital number.

FIG. 15 also illustrates the constant threshold voltage VTR. As shown by the RSEL signal 345*a*, for those periods when the ramp signal 730 exceeds the threshold voltage VTR, then RSEL signal 345*a* is asserted and deasserted otherwise. These signals create the following ordering. During the first window 580*a*, the first or "FULL" part is asserted followed by its second or "HALF" part. However, during the second window 580*b*, the HALF part is asserted followed by its FULL part. During the third window 580*c*, the FULL part is asserted followed by its HALF part and during the fourth window 580*d*, the HALF part is asserted followed by its FULL part. Although the order of the FULL and HALF parts have been altered, compared to the ordering of the first and second embodiments, the lengths of each FULL part of FIG. 15 are the same and the lengths of each HALF part of FIG. 15 are the same. It is appreciated that by varying the level of the threshold voltage VTR, the relative lengths of the FULL and HALF parts can be adjusted.

The resulting analog voltage signal driven over the ith red column line 250*f* is also shown in FIG. 15. By ordering the assertion of the FULL and HALF parts of the row on-time windows 580*a*–580*d* as shown in FIG. 15, the frequency of voltage change (and therefore integrated circuit power dissipation) is significantly reduced. For instance, V1 is asserted followed by (V1/2) followed by (V2/2) followed by V2 followed by V3 followed by (V4/2) followed by V4. Essentially by placing as many FULL voltage levels consecutive as possible and placing as many HALF voltage levels consecutive as possible, the present invention reduces the incidents of wide voltage level changes in the column driving voltages, thereby saving power.

Figure 16:
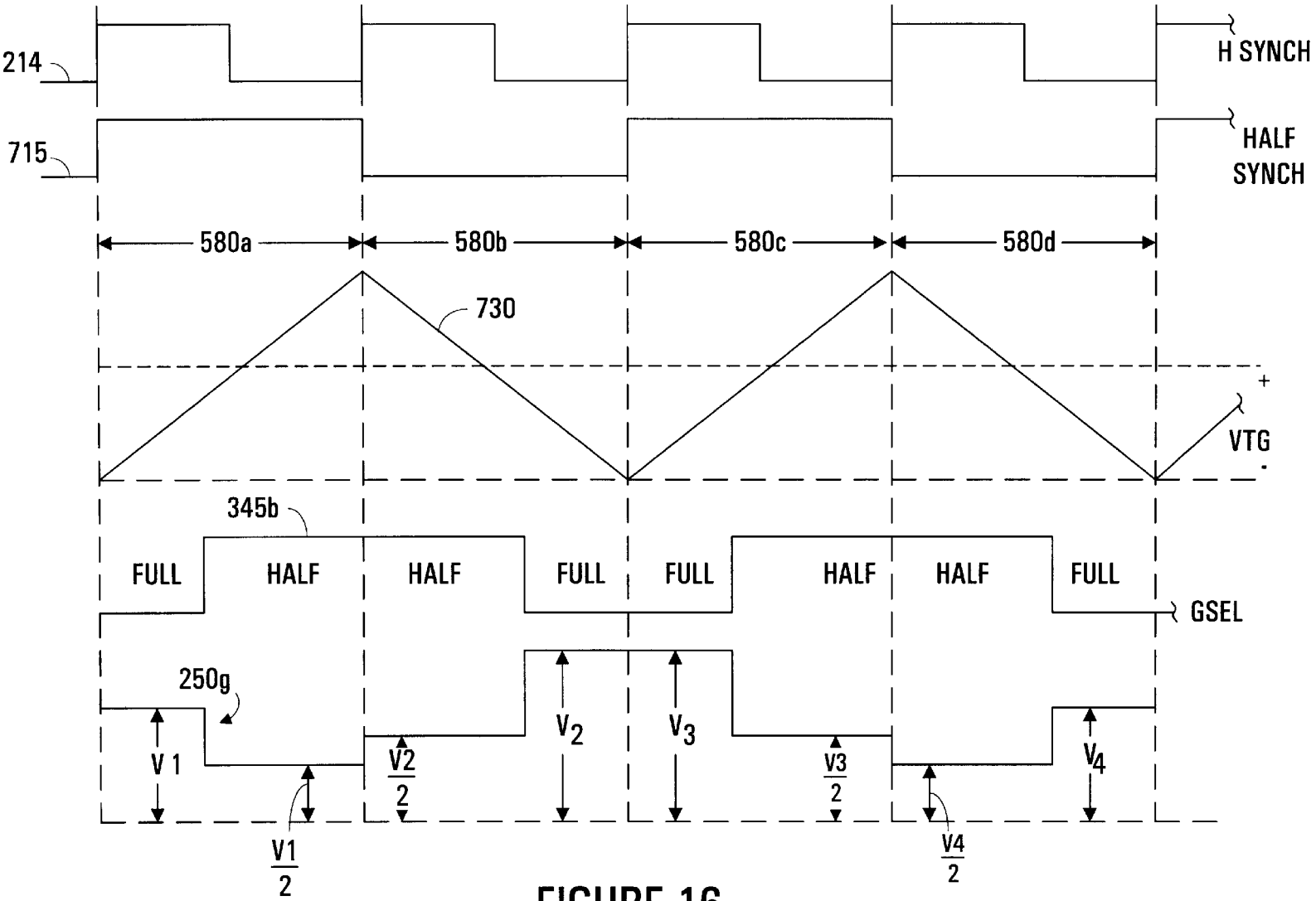
FIG. 16 illustrates timing diagrams of the relevant signals used by the third color balancing embodiment of the present invention for an exemplary color, e.g., green.

FIG. 16 illustrates timing diagrams of the pertinent signals used by the third embodiment of the present invention for the exemplary green column driver 240*b*(i)' of FIG. 9B. (In order for the exemplary green column driver 240*b*(i) to operate with the third embodiment, the driver would need to be modified such that the output shift register 320*b*(i) was able to simultaneously supply both the first or "full" voltage data and the second or "half" voltage data.) The horizontal synchronization clock 214 is shown divided into the four exemplary consecutive row on-time windows 580*a*–580*d*. The HALF H SYNCH signal 715 is also shown. The same ramp generation signal 730 is shown in FIG. 16 as is shown in FIG. 15.

FIG. 16 also illustrates the constant threshold voltage VTG which is lower in value than VTR of FIG. 15. As a result, the HALF parts of FIG. 16 are larger in duration than the HALF parts of FIG. 15. As shown by the GSEL signal 345*b*, for those periods when the ramp signal 730 exceeds the threshold voltage VTG, then GSEL signal 345*b* is asserted and deasserted otherwise. These signals create the following ordering. During the first window 580*a*, the first or "FULL" part is asserted followed by its second or "HALF" part. However, during the second window 580*b*, the HALF part is asserted followed by its FULL part. During the third window 580*c*, the FULL part is asserted followed by its HALF part and during the fourth window 580*d*, the HALF part is asserted followed by its FULL part. It is appreciated that by varying the level of the threshold voltage VTG, the relative lengths of the FULL and HALF parts can be adjusted.

The resulting analog voltage signal driven over the ith green column line 250*g* is also shown in FIG. 16. By ordering the assertion of the FULL and HALF parts of the row on-time windows 580*a*–580*d* as shown in FIG. 16, the frequency of voltage change (and therefore integrated circuit power dissipation) is significantly reduced as described with respect to FIG. 15.

Error Compensation Fourth Embodiment of the Present Invention

Within the embodiments of the present invention described above, the first voltage data is divided to generate a second voltage data for application during the second part of each row on-time window. Exemplary divide-by-two operations (e.g., right shift register, multiplexer) are described herein, although division by any value could be used. However, when dividing by two within the present invention, using either the shift mechanisms of the first embodiment or the multiplexer mechanisms of the second embodiment, the N-bit first voltage data value is translated into an (N−1) bit second voltage data value. For instance, a 7-bit first voltage data value is translated into a 6-bit second voltage data value by discarding the least significant bit (LSB) of the first voltage data.

This divide-by-two operation described above, in some cases, inherently leads to an error because of the loss of resolution attributed to translating from a first N-bit value to a second (N−1) bit value. For instance, consider a first voltage value of 63 units. The digital representation of this value is (0011 1111 B). The divide-by-two operation of the first and second embodiments, in effect, right shifts this value to obtain the value of (0001 1111B) or 31. However, the actual value of 63 divided by two is 31.5. Therefore, the shift right divide-by-two operation on a first voltage data of 63 yields a value, 31, that is smaller than the actual value of 31.5 and therefore, herein, is referred to as generating "negative" error. This is the case for all first voltage data values having a logical "1" in their LSBs, which is discarded. For this reason, the above error is also called a "−1" error.

However, the divide-by-two operation of the first and second embodiments does not always produce an error. Consider a first voltage value of 24 which is represented by (0001 1000B) in binary. The right shift divide operation produces a value of (0000 1100B) or 12 which is exactly half of 24. In this case, when the LSB of the first voltage data value is logical "0," no negative error is realized. Table 1 below illustrates full voltage values, their exact half value, the value that can be output by the output register 320 within each column driver circuit of the first and second embodiments of the present invention and the resulting error, if any, for an exemplary sample of inputs.

TABLE 1

| First Voltage Data | Exact Half Value | Second Voltage Data (in Output Reg 320) | Error |
|---|---|---|---|
| 0 | 0 | 0 | 0 |
| 1 | 0.5 | 0 | −0.5 |
| 2 | 1 | 1 | 0 |
| 3 | 1.5 | 1 | −0.5 |
| 4 | 2 | 2 | 0 |
| 5 | 2.5 | 2 | −0.5 |
| 6 | 3 | 3 | 0 |
| 7 | 3.5 | 3 | −0.5 |
| 8 | 4 | 4 | 0 |
| 9 | 4.5 | 4 | −0.5 |
| 10 | 5 | 5 | 0 |
| 11 | 5.5 | 5 | −0.5 |
| 12 | 6 | 6 | 0 |
| 13 | 6.5 | 6 | −0.5 |
| 14 | 7 | 7 | 0 |
| *** | *** | *** | *** |

Error Compensator Circuits. To compensate for the instances when a negative error appears, a fourth embodiment of the present invention is provided. Within the fourth embodiment of the present invention, two error compensation on circuits (also called "data translator" circuits) are provided within each column driver of each color. The two error compensation circuits are used to inplement the divide-by-two circuit that provides the second voltage data value during the second part of each row-on time window. Specifically, within the present invention, a first error compensation circuit is used during the first frame of each pair of consecutive frames (e.g., odd frames) of the FED 200 to produce second voltage data applicable to the activation of all rows and all columns of that first frame. A second error compensation circuit is used during the second frame of each pair of consecutive frames (e.g., even frames) to produce the second voltage data applicable to the activation of all rows and all columns of that second frame. It is appreciated that a frame represents the activation of all rows and all columns (e.g., all pixels are activated). The frame rate of one embodiment of the present invention is approximately 60 frames per second and can be composed of one or more fields.

Figure 17A:
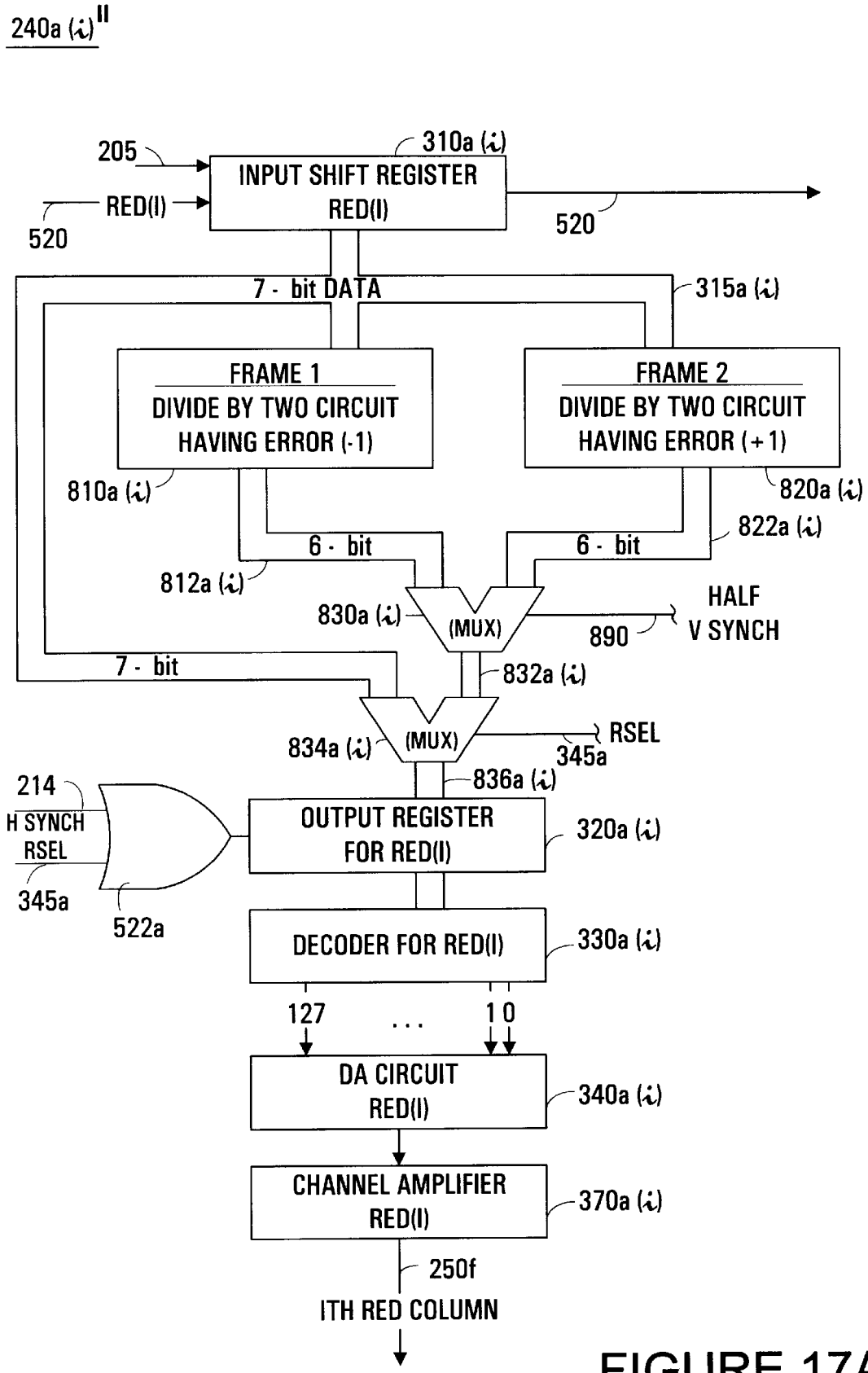
FIG. 17A illustrates error compensation circuitry used within the (ith) red column driver within a fourth embodiment of the present invention.
Figure 17B:
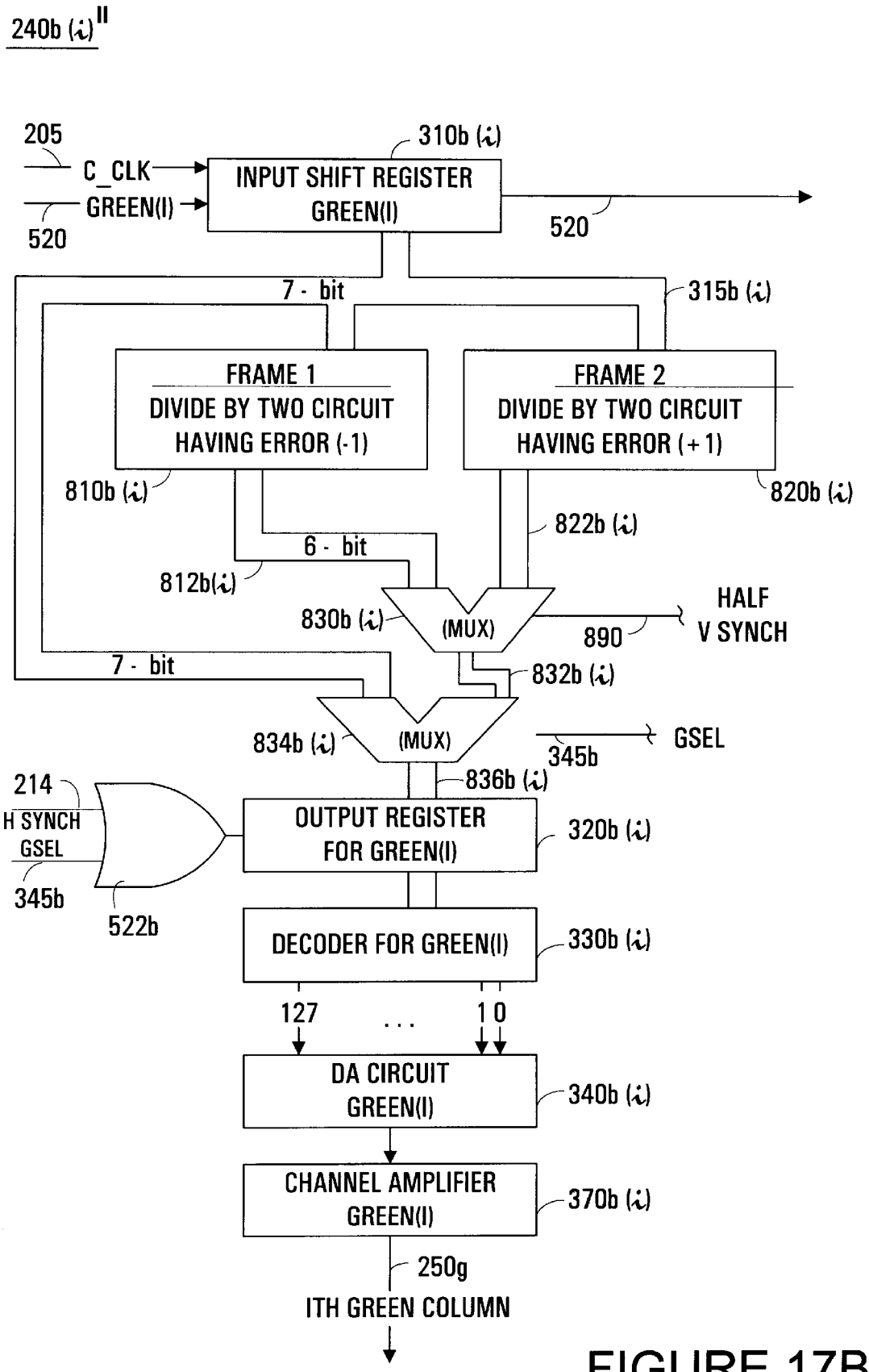
FIG. 17B illustrates error compensation circuitry used within the (ith) green column driver within the fourth embodiment of the present invention.
Figure 17C:
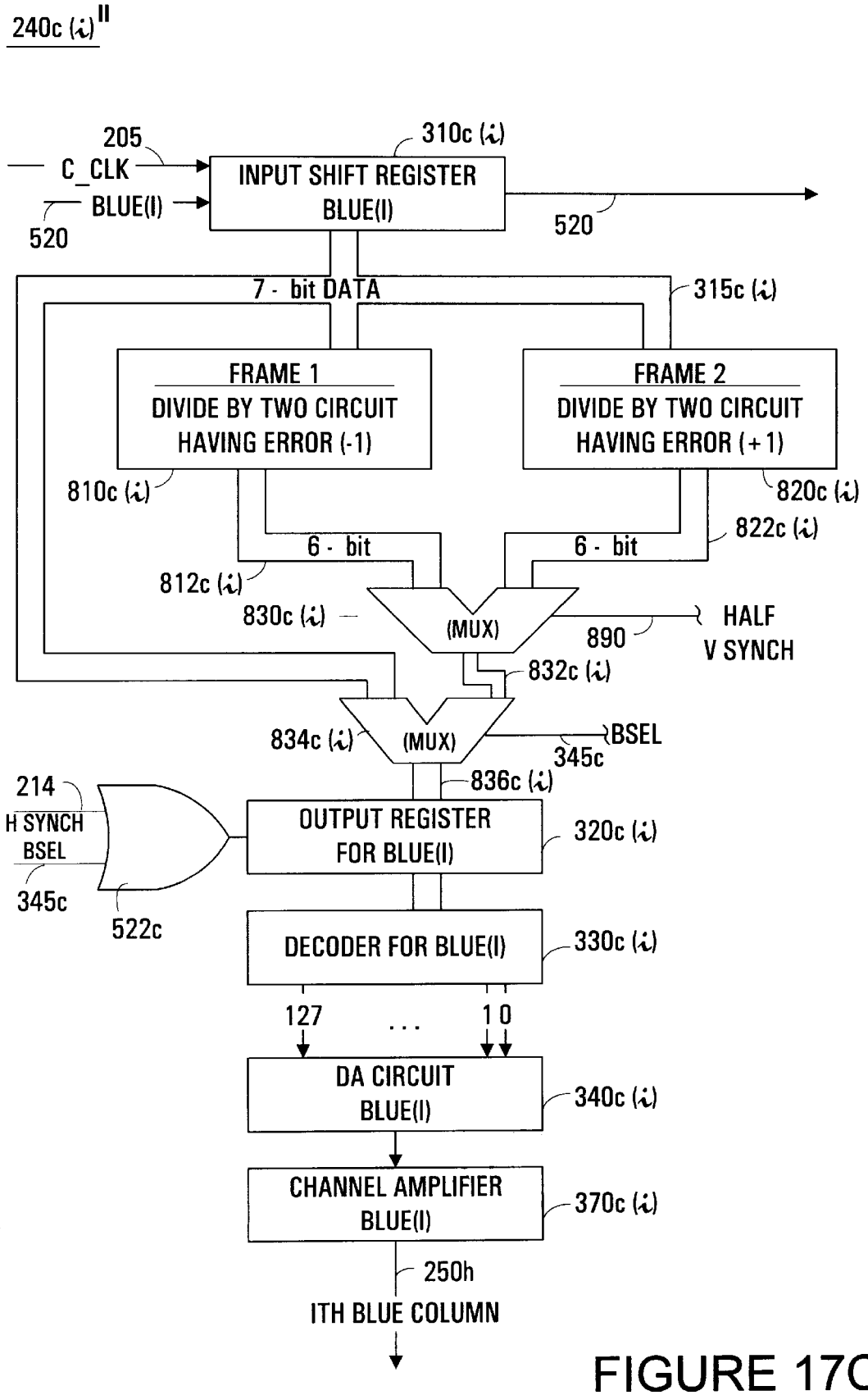
FIG. 17C illustrates error compensation circuitry used within the (ith) blue column driver within a fourth embodiment of the present invention.

FIG. 17A, FIG. 17B and FIG. 17C illustrate the circuitry used by the fourth embodiment of the present invention for adjusting color balance within an FED screen 200 for three exemplary column drivers: the ith red column driver 240*a*(i)" of the n red column drivers 240*a*, the ith green column driver 240*b*(i)" of the n green column drivers 240*b* and the ith blue column driver 240*c*(i)" of the n blue column drivers 240*c*. These three exemplary ith column drivers represent the ith pixel along a given row of pixels. Components within FIGS. 17A, 17B and 17C that have the "(i)" designation are replicated for each column driver of the same color as the exemplary column driver to which they are described. Components without the "(i)" designation are not replicated within each column driver but rather are shared by all column drivers, or all column drivers of a similar color, as described more particularly below.

FIG. 17A illustrates error compensation circuitry used within the (ith) red column driver 240*a*(i)" within the fourth embodiment of the present invention. Bus 520 clocks a first red voltage data, having N-bits, into the input shift register 310*a*(i) which asserts this first red voltage data over bus 315*a*(i). In this example, N is 7. The first (or "frame 1") error compensation circuit 810*a*(i) generates an (N−1) bit output value over bus 812*a*(i) that represents the first red voltage data divided in half according to the output of Table 1 (above). The shift right mechanism of the first embodiment or the multiplexer mechanism of the second embodiment of the present invention can be used as the first error compensation circuit 810*a*(i).

FIG. 17A also contains a second (or "frame 2") error compensation circuit 820*a*(i) which also receives the first red voltage data over bus 315*a*(i). The second error compensation circuit 820*a*(i) generates an (N−1) bit output value over bus 822*a*(i) that represents the first red voltage data divided in half according to the output of Table 2 (below). As seen from Table 2, the second error compensation circuit 820*a*(i) generates a positive error for all first voltage data values having a "1" in their LSB.

TABLE 2

| First Voltage Data | Exact Half Value | Second Voltage Data (in Output Reg 320) | Error |
|---|---|---|---|
| 0 | 0 | 0 | 0 |
| 1 | 0.5 | 1 | +0.5 |
| 2 | 1 | 1 | 0 |
| 3 | 1.5 | 2 | +0.5 |
| 4 | 2 | 2 | 0 |
| 5 | 2.5 | 3 | +0.5 |
| 6 | 3 | 3 | 0 |
| 7 | 3.5 | 4 | +0.5 |
| 8 | 4 | 4 | 0 |
| 9 | 4.5 | 5 | +0.5 |
| 10 | 5 | 5 | 0 |
| 11 | 5.5 | 6 | +0.5 |
| 12 | 6 | 6 | 0 |
| 13 | 6.5 | 7 | +0.5 |
| 14 | 7 | 7 | 0 |
| *** | *** | *** | *** |

The positive error generated by the second error compensation circuit 820*a*(i) is equal and opposite in sign compared to the negative error generated by the second error compensation circuit 810*a*(i). It is appreciated that for both the first and second error generation circuits 810*a*(i) and 820*a*(i), if the first voltage data contains a "0" in its LSB, then no error is generated as shown by Table 1 and Table 2.

The data value over bus 812*a*(i) of FIG. 17A is the second red voltage data having negative correction while the data value over bus 822*a*(i) is the second red voltage data having positive correction. The data values over bus 812*a*(i) and bus 822*a*(i) are both fed to multiplexer 830*a*(i) which selects one of the two (N−1) data values and supplies this value over bus 832*a*(i) to one input of another multiplexer 834*a*(i). The other input of multiplexer 834*a*(i) receives the full N-bit value representing the first red voltage data of bus 315*a*(i). The select line of multiplexer 830*a*(i) is controlled by a form of the vertical blanking pulse over line 890. The signal over line 890 is configured such that during odd frames, multiplexer 830*a*(i) selects the value from bus 812*a*(i) and during even frames, multiplexer 830*a*(i) selects the value from bus 822*a*(i). Or, the mux selection could be configured vice-versa with respect to odd/even frames in an alternative implementation.

In order to properly supply the correct voltage data value during first ("full") and second ("half") parts of each row-on time window, the select line of multiplexer 834*a*(i) is controlled by the RSEL line 345*a* which can be generated by the timing circuits of the first, second or third embodiments of the present invention. Circuits 320*a*(i), 330*a*(i), 340*a*(i) and 370*a*(i) operate in fashions analogous to the ith red column driver circuit 240*a*(i)' described with respect to FIG. 9A.

The channel amplifier 370*a*(i) generates two different time multiplexed red voltage signals over column line 250*f* for each row on-time window. In accordance with the fourth embodiment, during each odd frame, the second or "half" voltage of each of the x row-on time windows contains negative error and during each even frame, the second or "half' voltage of each of the x row-on time windows contains positive error. The time multiplexing for red is controlled by the RSEL line 345*a*. It is appreciated that circuit 522*a*, signal 345*a*, the horizontal synchronization signal 214, the clock signal 205, vertical signal 890 and column data bus 520 are used by all of the n red column driver circuits of the fourth embodiment of the present invention.

FIG. 17B illustrates circuitry with an exemplary green column driver 240*b*(i)" that drives the ith green column line 250*g* (FIG. 7) for the ith pixel (of the n horizontal pixels) of the FED screen 200. The circuitry of FIG. 17B, although replicated for and pertinent to the ith green column driver 240*b*(i)", is analogous to the circuitry of FIG. 17A except a green color data value is received over bus 520 for the ith pixel and the row on-time window is time multiplexed according to a GSEL line 345*b*, not the RSEL line 345*a*. Also, a different OR gate circuit 522*b* is used.

The channel amplifier 370*b*(i) generates two different time multiplexed green voltage signals over column line 250*g* for each row on-time window. During each odd frame, the second or "half' voltage of each of the x row-on time windows contains negative error and during each even frame, the second or "half" voltage of each of the x row-on time windows contains positive error. It is appreciated that circuit 522*b*, signal 345*b*, the horizontal synchronization signal 214, the clock signal 205, vertical signal 890 and column data bus 520 are used by all of the n green column driver circuits of the fourth embodiment of the present invention.

FIG. 17C illustrates circuitry with an exemplary blue column driver 240*b*(i)" that drives the ith blue column line 250*h* (FIG. 7) for the ith pixel (of the n horizontal pixels) of the FED screen 200. The circuitry of FIG. 17C, although replicated for and pertinent to the ith blue column driver 240*c*(i)", is analogous to the circuitry of FIG. 17A except a blue color data value is received over bus 520 for the ith pixel and the row on-time window is time multiplexed according to a BSEL line 345*c*, not the RSEL line 345*a*. Also, a different OR gate circuit 522*c* is used.

The channel amplifier 370*c*(i) generates two different time multiplexed blue voltage signals over column line 250*h* for each row on-time window. The time multiplexing for blue is controlled by the BSEL line 345*c*. It is appreciated that circuit 522*c*, signal 345*c*, the horizontal synchronization signal 214, the clock signal 205, vertical signal 890 and column data bus 520 are used by all of the n blue column driver circuits of the fourth embodiment of the present invention.

Figure 18:
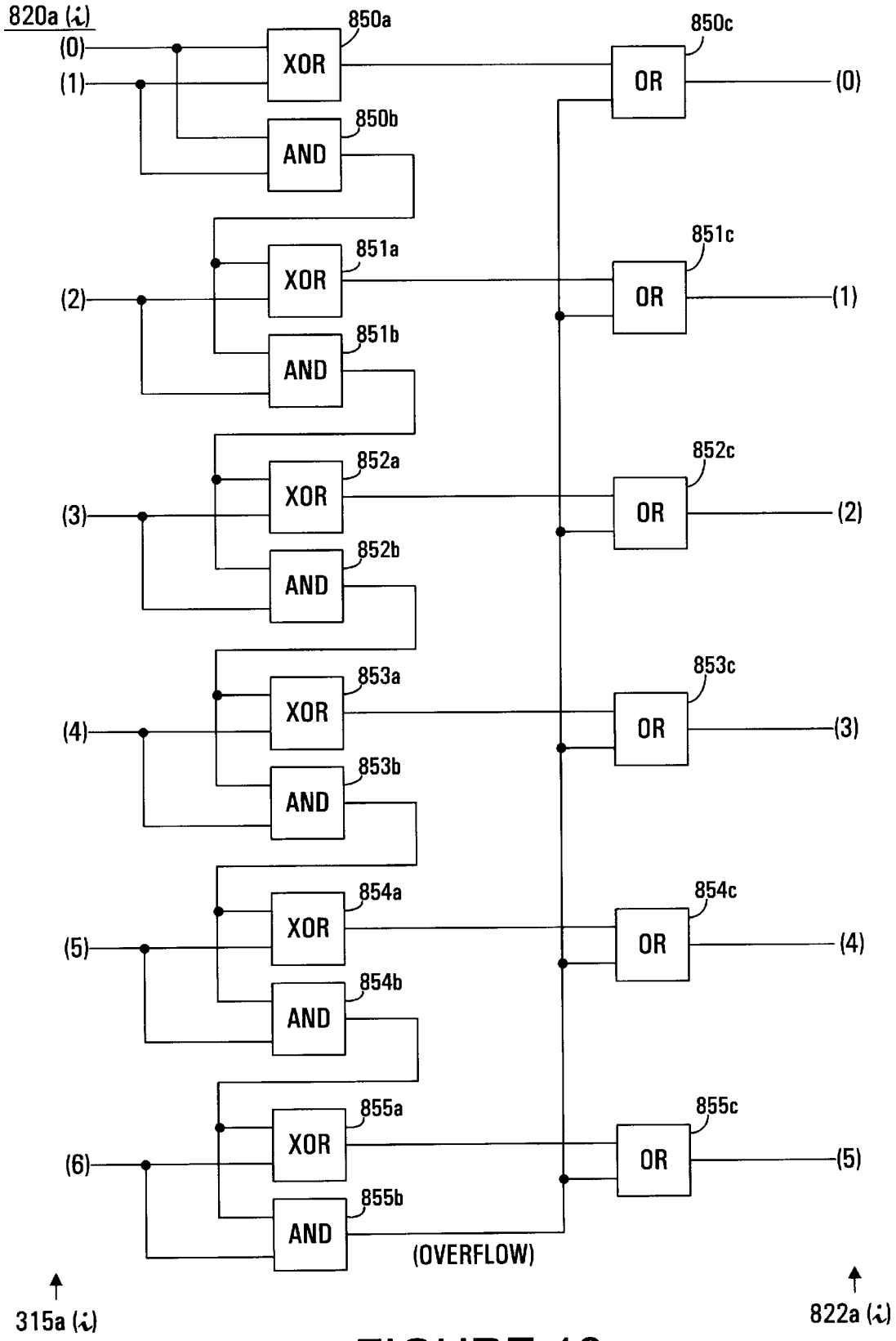
FIG. 18 is a schematic diagram of an error compensation circuit used by column drivers of the fourth embodiment of the present invention during the second frame of each consecutive display frame pair.

FIG. 18 illustrates a circuit using multiple circuit stages of coupled XOR gates 850*a*–855*a* and AND gates 850*b*–855*b* for realizing the second error compensation circuit for any of the column drivers of the fourth embodiment of the present invention. With respect to the second error compensation circuit, an N-bit value is received and an (N−1) bit output is generated having positive error contribution as shown in Table 2 (above).

As an example only, FIG. 18 illustrates the design applicable to the second error compensation circuit 820*a*(i) of FIG. 17A. The (0), e.g., LSB, and (1) lines of 7-bit bus 315*a*(i) are fed to XOR 850*a* and AND 850*b*. Each other line (3)–(6) of bus 315*a*(i) is coupled, respectively, to XOR gates 851*a*–855*a* and to AND gates 851*b*–855*b*. Also, each XOR and each AND gate of a given stage receives the output of the AND gate of its upstream stage. The outputs of each of the XOR gates 850*a*–855*a* are fed, respectively, to OR gates 850*c*–855*c*. The outputs of the OR gates 850*c*–855*c* constitute the 6 lines of 6-bit bus 822*a*(i) as shown. The OR gates 850*c*–855*c* are merely provided to implement an "overflow" condition so that circuit 820*a*(i) generates all "1s" in the instance of an overflow generated from AND gate 855*b*. It is appreciated that while circuit 820*a*(i) is shown for an input having 7 bits, this design could readily be modified to accept an input having any number, e.g., N bits, by altering the number of circuit stages and respective outputs.

Figure 19:
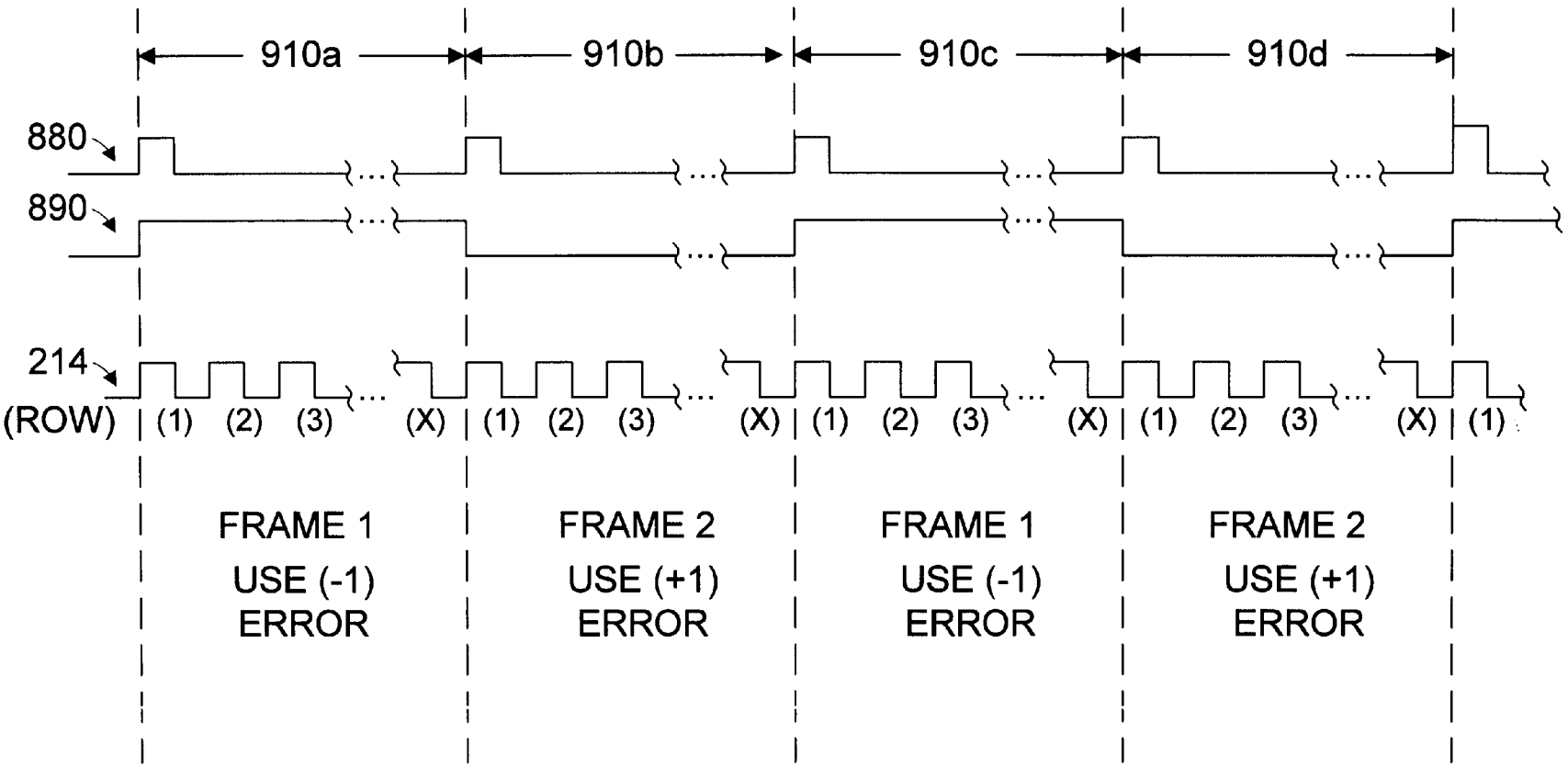
FIG. 19 illustrates timing diagrams of the relevant signals used by the fourth color balancing embodiment of the present invention over four consecutive frames (e.g., vertical synchronization pulses).

FIG. 19 illustrates timing diagrams of relevant signals used by the fourth color balancing embodiment of the present invention over four consecutive and exemplary frames 910*a*–910*d*. As discussed, frames are presented at a rate of 60 Hz in one implementation. At the start of each frame 910*a*–910*d*, a pulse is generated on the vertical blanking signal 880 to mark the start of the frame. The vertical signal 890, used for controlling multiplexers 830*a* (i), 830*b*(i) and 830*c*(i), is derived from the vertical blanking signal 880 using well known techniques and can be generated using a configured flip flop circuit. The vertical signal 890 is a level signal and toggles between a value of "0" and "1," respectively, for consecutive frames and thereby defines the first and second frames of each frame pair.

Also shown in FIG. 19 is the horizontal synchronization signal 214. As shown, for each frame, the horizontal synchronization signal 214 provides a separate row on-time window for each of the (x) rows of the FED 200. In particular, x row on-time windows on signal 214 are provided for each frame. In accordance with the fourth embodiment of the present invention, during the "frame1" or first frames (e.g., 910*a* and 910*c*), signal 890 selects the output of the first error compensation circuit of each column driver to provide negative error for the second ("half") parts of each row on-time window. During the "frame2" or second frames (e.g., 910*b* and 910*d*), signal 890 selects the output of the second error compensation circuit of each column driver to provide positive error for the second ("half") parts of each row on-time window. By selecting alternating negative and positive error corrections, the actual voltage output by each column driver is given increased resolution and therefore increased accuracy.

Figure 20B:
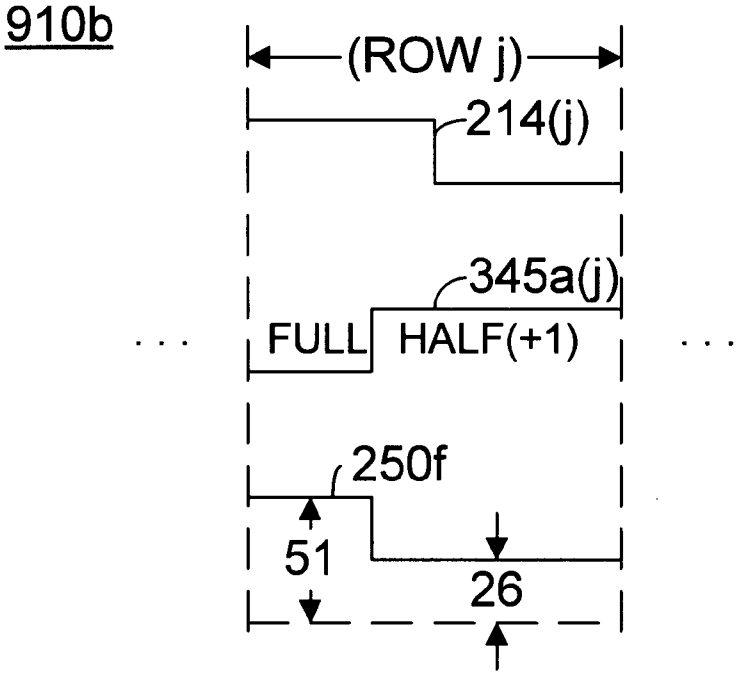
FIG. 20B illustrates pertinent signals used by the fourth embodiment of the present invention during a second frame for the exemplary red column driver at the ith pixel position along the ith row line and using positive correction.
Figure 20A:
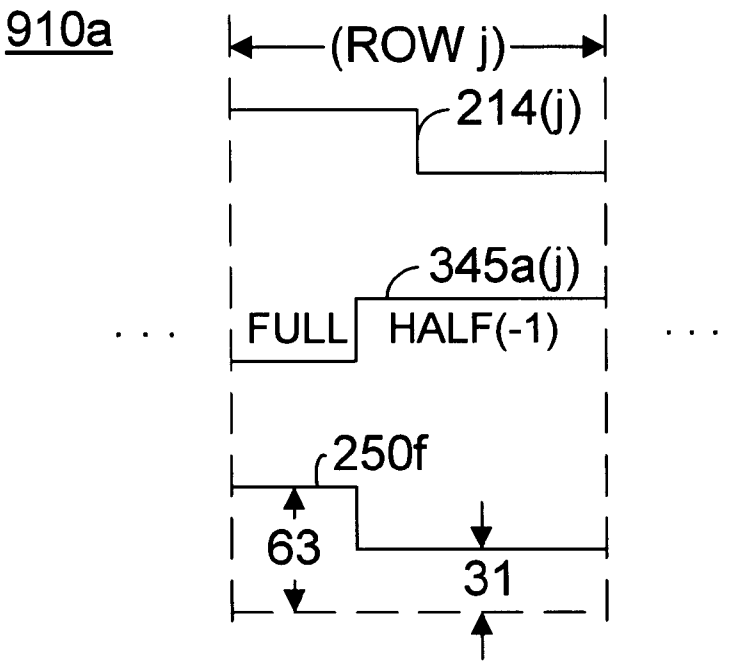
FIG. 20A illustrates pertinent signals used by the fourth embodiment of the present invention during a first frame for an exemplary red column driver at the ith pixel position along the ith row line and using negative correction.

FIG. 20A illustrates pertinent signals used by the fourth embodiment of the present invention during frame 910*a* (of FIG. 19) for the exemplary red column driver 240*a*(i)" at the ith pixel position and pertinent to the ith row line. The row on-time pulse 214(j) is shown for row (j). The corresponding RSEL signal 345*a*(j) is also shown for row (j). The analog voltage over the ith red column line 250*f* is also shown. In the first or "full" part, an exemplary value of 63 is produced and during the second or "half" part, the value of 31 is produced. The value 31 contains negative error because frame 910*a* is a first frame and therefore the output from first error compensation circuit 810*a*(i) is used.

FIG. 20B illustrates pertinent signals used by the fourth embodiment of the present invention during frame 910*b* for the exemplary red column driver 240*a*(i)" at the ith pixel position and pertinent to the ith row line. The row on-time pulse 214(j) is shown for row (j). The corresponding RSEL signal 345*a*(j) is also shown for row (j). The analog voltage over the ith red column line 250*f* is also shown. In the first or "full" part, an exemplary value of 51 is produced at frame 910*b* and during the second or "half" part, the value of 26 is produced. The value 26 contains positive error because frame 910*b* is a second frame and therefore the output from second error compensation circuit 820*a*(i) is used.

In accordance with the fourth embodiment of the present invention, statistically the consecutive presentation of values having possible negative error correction (e.g., value 31 above) and possible positive error correction (e.g., value 26 above) helps to reduce the error attributed to the division of an N-bit number into a product having only (N−1) bits. This is the case even though different column data values are presented to the same pixel over the two frames because the correction is statistically based.

Figure 20D:
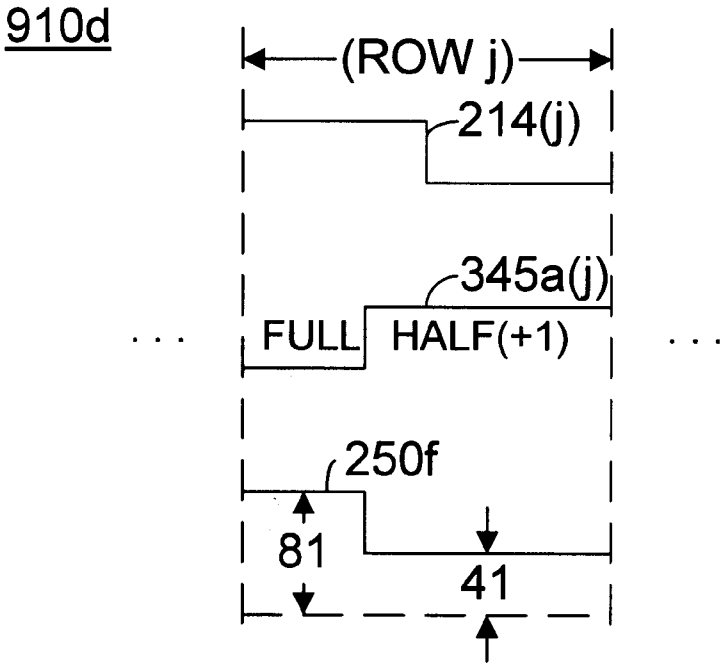
FIG. 20D illustrates pertinent signals used by the fourth embodiment of the present invention during a fourth frame for the exemplary red column driver at the ith pixel position along the ith row line and using positive correction.
Figure 20C:
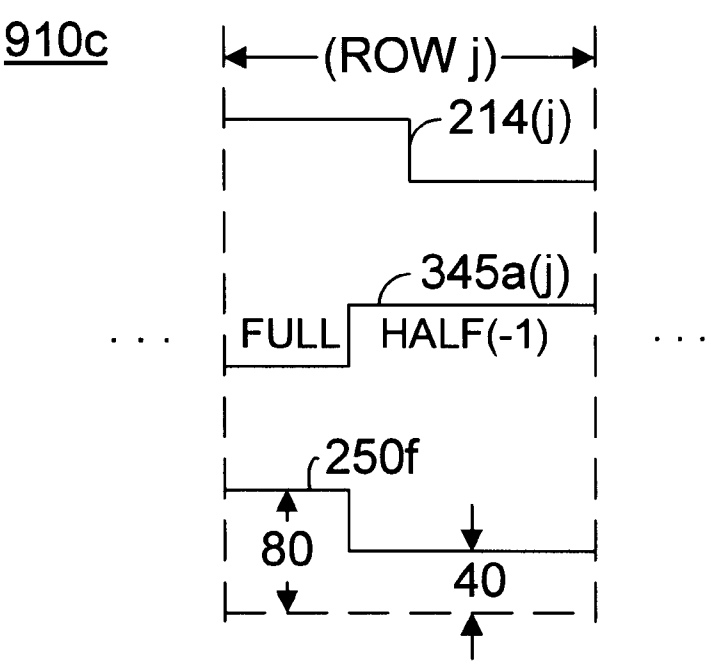
FIG. 20C illustrates pertinent signals used by the fourth embodiment of the present invention during a third frame for the exemplary red column driver at the ith pixel position along the ith row line and using negative correction.

FIG. 20C illustrates pertinent signals used by the fourth embodiment of the present invention during frame 910*c* for the exemplary red column driver 240*a*(i)" at the ith pixel position and pertinent to the ith row line. The row on-time pulse 214(j) is shown for row (j). The corresponding RSEL signal 345*a*(j) is also shown for row (j). The analog voltage over the ith red column line 250*f* is also shown. In the first or "full" part, an exemplary value of 80 is produced at frame 910*c* and during the second or "half" part, the value of 40 is produced which has no negative or positive error. The value 40 contains no error and, because frame 910*c* is a first frame, the output from first error compensation circuit 810*a*(i) is used.

FIG. 20D illustrates pertinent signals used by the fourth embodiment of the present invention during frame 910*d* for the exemplary red column driver 240*a*(i)" at the ith pixel position and pertinent to the ith row line. The row on-time pulse 214(j) is shown for row (j). The corresponding RSEL signal 345*a*(j) is also shown for row (j). The analog voltage over the ith red column line 250*f* is also shown. In the first or "full" part, an exemplary value of 81 is produced at frame 910*d* and during the second or "half" part, the value of 41 is produced. The value 41 contains positive error because frame 910*d* is a second frame and therefore the output from second error compensation circuit 820*a*(i) is used.

It is appreciated that the fourth embodiment of the present invention provides mirror positive and negative error compensation regardless of the relative lengths of the first ("full") and second ("half") parts of each row on-time window. This is the case because over two consecutive frames, the relative lengths of the full and half parts of each row on-time window are the same, thereby producing the same error (either positive or negative).

The preferred embodiment of the present invention, a method and mechanism for using time multiplexing of voltage signals for dynamically altering the color balance within a flat panel FED screen without significantly compromising gray-scale resolution, is thus described. While the present invention has been described in particular embodiments, it should be appreciated that the present invention should not be construed as limited by such embodiments, but rather construed according to the below claims.

What is claimed is:

1. A field emission display device comprising:

a plurality of row drivers, each for driving a row voltage signal over a respective row line, one at a time, during a row on-time window, wherein row on-time windows are synchronized by a horizontal synchronization clock signal; and a plurality of column drivers of first, second and third colors, each column driver coupled to a respective column line and for time multiplexing thereon different voltages during a first part and a second part of each row on-time window, each column driver comprising:

a first error compensation circuit for dividing an N-bit data value into a first (N−1) bit data value having negative error;

a second error compensation circuit for dividing said N-bit data value into a second (N−1) bit data value having positive error;

a selector circuit for providing output data as follows: for each first part, said N-bit data value is provided; and for each second part, said first (N−1) bit data value and second (N−1) bit data value are provided, respectively, for frames of each consecutive frame pair; and a digital to analog converter for converting said output data into analog voltage signals for driving said respective column line.

2. A field emission display device as described in claim 1 wherein said selector circuit of each column driver comprises:

a first multiplexer for selecting between said first (N−1) bit data value and said second (N−1) bit data value based on a vertical timing signal; and a second multiplexer for selecting between an output of said first multiplexer and said N-bit data value, to provide said output data, based on a color select signal defining said first and second parts.

3. A field emission display device as described in claim 2 further comprising a timing circuit for generating a first color select signal coupled to each column driver of said first color, a second color select signal coupled to each column driver of said second color and a third color select signal coupled to each column driver of said third color, each color select signal for defining a first part and a second part for a respective color.

4. A field emission display device as described in claim 1 wherein said first (N−1) bit data value is slightly less than half said N-bit data value provided said N-bit data value is odd and said second (N−1) bit data value is slightly more than half said N-bit data value provided said N-bit data value is odd.

5. A field emission display device as described in claim 4 wherein said first (N−1) bit data value and said second (N−1) bit data value are each exactly half said N-bit data value provided said N-bit data value is even.

6. A field emission display device as described in claim 1 wherein said second error compensation circuit comprises (N−1) stages of coupled XOR and AND gates.

7. A field emission display device as described in claim 1 wherein for each pair of consecutive row on-time windows, said first and second parts are ordered as follows: first; second; first; second.

8. A field emission display device as described in claim 1 wherein for each pair of consecutive row on-time windows, said first and second parts are ordered as follows: first; second; second; first.

9. A field emission display device comprising:

a plurality of row drivers, each for driving a row voltage signal over a respective row line, one at a time, during a row on-time window, wherein row on-time windows are synchronized by a horizontal synchronization clock signal; and a plurality of column drivers of red, green and blue colors, each column driver coupled to a respective column line and for time multiplexing thereon different voltages during a first part and a second part of each row on-time window, each column driver comprising:

a first error compensation circuit for dividing an N-bit data value into a first (N−1) bit data value having negative error;

a second error compensation circuit for dividing said N-bit data value into a second (N−1) bit data value having positive error;

a selector circuit for providing output data as follows: for each first part, said N-bit data value is provided; and for each second part, said first (N−1) bit data value and second (N−1) bit data value are provided, respectively, for first and second frames of each consecutive frame pair; and a digital to analog converter for converting said output data into analog voltage signals for driving said respective column line.

10. A field emission display device as described in claim 9 wherein said selector circuit of each column driver comprises:

a first multiplexer for selecting between said first (N−1) bit data value and said second (N−1) bit data value based on a vertical timing signal; and a second multiplexer for selecting between an output of said first multiplexer and said N-bit data value, to provide said output data, based on a color select signal defining said first and second parts.

11. A field emission display device as described in claim 10 further comprising a timing circuit for generating a red color select signal coupled to each column driver of said red color, a green color select signal coupled to each column driver of said green color and a blue color select signal coupled to each column driver of said blue color, each color select signal for defining a first part and a second part for a respective color.

12. A field emission display device as described in claim 9 wherein said first (N−1) bit data value is slightly less than half said N-bit data value provided said N-bit data value is odd and said second (N−1) bit data value is slightly more than half said N-bit data value provided said N-bit data value is odd and wherein said first (N−1) bit data value and said second (N−1) bit data value are each exactly half said N-bit data value provided said N-bit data value is even.

13. A field emission display device as described in claim 9 wherein said second error compensation circuit comprises (N−1) stages of coupled XOR and AND gates.

14. A field emission display device as described in claim 9 wherein for each pair of consecutive row on-time windows, said first and second parts are ordered as follows: first; second; first; second.

15. A field emission display device as described in claim 9 wherein for each pair of consecutive row on-time windows, said first and second parts are ordered as follows: first; second; second; first.

16. A column driver of an field emission device comprising:

an input shift register for receiving an N-bit data value representing a first voltage signal;

a first error compensation circuit coupled to said input shift register for dividing said N-bit data value into a first (N−1) bit data value having negative error;

a second error compensation circuit coupled to said input shift register for dividing said N-bit data value into a second (N−1) bit data value having positive error;

a selector circuit for providing an output data value as follows: for a first part of each row on-time window, said N-bit data value is provided; and for a second part of each row on-time window, said first (N−1) bit data value and second (N−1) bit data value are provided, respectively, for first and second frames of each consecutive frame pair; and a digital to analog converter for converting data values provided from said selector circuit into voltage signals for driving over a respective column line.

17. A column driver as described in claim 16 wherein said selector circuit comprises:

a first multiplexer for selecting between said first (N−1) bit data value and said second (N−1) bit data value based on a vertical timing signal; and a second multiplexer for selecting between an output of said first multiplexer and said N-bit data value, to provide said output data, based on a color select signal defining said first and second parts.

18. A column driver as described in claim 16 wherein said first (N−1) bit data value is slightly less than half said N-bit data value provided said N-bit data value is odd and said second (N−1) bit data value is slightly more than half said N-bit data value provided said N-bit data value is odd and wherein said first (N−1) bit data value and said second (N−1) bit data value are each exactly half said N-bit data value provided said N-bit data value is even.

19. A column driver as described in claim 16 wherein for each pair of consecutive row on-time windows, said first and second parts are ordered as follows: first; second; first; second.

20. A column driver as described in claim 16 wherein for each pair of consecutive row on-time windows, said first and second parts are ordered as follows: first; second; second; first.

* * * * *